US009051812B2

(12) United States Patent
Clemens et al.

(10) Patent No.: US 9,051,812 B2
(45) Date of Patent: Jun. 9, 2015

(54) THROUGH TUBING BRIDGE PLUG AND INSTALLATION METHOD FOR SAME

(75) Inventors: Jack Gammill Clemens, Fairview, TX (US); Wesley Neil Ludwig, Fort Worth, TX (US); James Dan Vick, Jr., Dallas, TX (US); John Patrick Rodgers, Keller, TX (US); Edwin A. Eaton, Grapevine, TX (US); Marco Serra, Dinhard (CH)

(73) Assignee: Halliburton Energy Services, Inc., Houston, TX (US)

( * ) Notice: Subject to any disclaimer, the term of this patent is extended or adjusted under 35 U.S.C. 154(b) by 324 days.

(21) Appl. No.: 12/889,367

(22) Filed: Sep. 23, 2010

(65) Prior Publication Data

US 2011/0073310 A1 Mar. 31, 2011

(51) Int. Cl.

| | |
|---|---|
| ***E21B 33/00*** | (2006.01) |
| ***E21B 33/12*** | (2006.01) |
| ***E21B 23/01*** | (2006.01) |
| ***E21B 23/06*** | (2006.01) |
| ***E21B 33/128*** | (2006.01) |
| ***E21B 33/129*** | (2006.01) |
| ***E21B 33/134*** | (2006.01) |
| ***E21B 33/136*** | (2006.01) |

(52) U.S. Cl.

CPC ..... *E21B 33/1208* (2013.01); *E21B 23/01* (2013.01); *E21B 23/06* (2013.01); *E21B 33/1216* (2013.01); *E21B 33/128* (2013.01); *E21B 33/129* (2013.01); *E21B 33/134* (2013.01); *E21B 33/136* (2013.01)

(58) Field of Classification Search

USPC ..... 166/386, 285, 135, 192, 373, 137, 140

See application file for complete search history.

(56) References Cited

U.S. PATENT DOCUMENTS

| | | | |
|---|---|---|---|
| 2,767,794 | A | 10/1956 | Lynes |
| 2,836,252 | A | 5/1958 | Lane |
| 3,282,347 | A | 11/1966 | Chenoweth |
| 3,385,368 | A | 5/1968 | Solum |
| 3,460,624 | A | 8/1969 | Aitken |

(Continued)

FOREIGN PATENT DOCUMENTS

WO 2004016903 2/2004

OTHER PUBLICATIONS

BTU, High Expansion Gauge Hanger, Undated but admitted prior art.

(Continued)

*Primary Examiner* — Cathleen Hutchins
*Assistant Examiner* — Taras P Bemko
(74) *Attorney, Agent, or Firm* — Haynes and Boone, LLP

(57) ABSTRACT

A through tubing bridge plug (200) for providing a gripping and sealing engagement with a casing string of a wellbore. The bridge plug (200) includes an actuation rod (208), an anchor assembly (212), a pair of compression assemblies, each including a support assembly (216, 242) and an anti extrusion assembly (220, 238) and a packing assembly (224) disposed about the actuation rod (208) between the compression assemblies. Responsive to longitudinal movement of the actuation rod (208), the anchor assembly (212) establishes the gripping engagement with the casing string, the compression assemblies are radially deployed such that the anti extrusion assemblies (220, 238) are supported by the support assemblies (216, 242) and the packing assembly (224) establishes the sealing engagement with the casing string.

13 Claims, 20 Drawing Sheets

(56) References Cited

U.S. PATENT DOCUMENTS

| | | | | |
|---|---|---|---|---|
| 3,520,360 | A | 7/1970 | Kisling | |
| 3,572,433 | A | 3/1971 | Conrad | |
| 3,623,550 | A | 11/1971 | De La Jarte et al. | |
| 3,706,342 | A * | 12/1972 | Woolley | 277/340 |
| 3,872,925 | A | 3/1975 | Owen et al. | |
| 3,891,034 | A | 6/1975 | Owen et al. | |
| 4,151,875 | A * | 5/1979 | Sullaway | 166/126 |
| 4,423,783 | A | 1/1984 | Haag | |
| 4,491,178 | A | 1/1985 | Terrell et al. | |
| 4,545,433 | A | 10/1985 | Wambaugh | |
| 4,554,973 | A | 11/1985 | Shonrock et al. | |
| 4,576,042 | A | 3/1986 | Johnson | |
| 4,671,356 | A | 6/1987 | Barker et al. | |
| 4,926,937 | A | 5/1990 | Hademenos | |
| 4,949,793 | A | 8/1990 | Rubbo et al. | |
| 5,010,958 | A | 4/1991 | Meek et al. | |
| 5,127,537 | A | 7/1992 | Graham | |
| 5,392,856 | A | 2/1995 | Broussard, Jr. et al. | |
| 5,579,839 | A | 12/1996 | Culpepper | |
| 5,603,511 | A | 2/1997 | Keyser, Jr. et al. | |
| 5,678,635 | A | 10/1997 | Dunlap et al. | |
| 5,775,429 | A | 7/1998 | Arizmendi et al. | |
| 6,059,033 | A | 5/2000 | Ross et al. | |
| 6,073,692 | A | 6/2000 | Wood et al. | |
| 6,102,117 | A | 8/2000 | Swor et al. | |
| 6,142,227 | A | 11/2000 | Hiorth et al. | |
| 6,145,598 | A | 11/2000 | Carisella | |
| 6,234,249 | B1 | 5/2001 | Andersen et al. | |
| 6,257,339 | B1 | 7/2001 | Haugen et al. | |
| 6,311,778 | B1 | 11/2001 | Carisella et al. | |
| 6,318,460 | B1 | 11/2001 | Swor et al. | |
| 6,318,461 | B1 | 11/2001 | Carisella | |
| 6,354,372 | B1 | 3/2002 | Carisella et al. | |
| 6,364,375 | B1 | 4/2002 | Szapucki et al. | |
| 6,516,898 | B1 | 2/2003 | Krueger | |
| 6,598,672 | B2 | 7/2003 | Bell et al. | |
| 6,612,372 | B1 | 9/2003 | Freiheit et al. | |
| 6,769,491 | B2 | 8/2004 | Zimmerman et al. | |
| 6,796,380 | B2 | 9/2004 | Xu | |
| 6,827,150 | B2 | 12/2004 | Luke | |
| 6,986,390 | B2 | 1/2006 | Doane et al. | |
| 7,004,248 | B2 | 2/2006 | Hoffman et al. | |
| 7,051,810 | B2 | 5/2006 | Clemens et al. | |
| 7,090,007 | B2 | 8/2006 | Stuart-Bruges et al. | |
| 7,096,949 | B2 | 8/2006 | Weber et al. | |
| 7,104,323 | B2 | 9/2006 | Cook et al. | |
| 7,128,145 | B2 | 10/2006 | Mickey | |
| 7,172,029 | B2 | 2/2007 | Hirth et al. | |
| 7,178,602 | B2 | 2/2007 | Hiorth et al. | |
| 7,290,603 | B2 | 11/2007 | Hiorth et al. | |
| 7,387,158 | B2 | 6/2008 | Murray et al. | |
| 7,594,542 | B2 | 9/2009 | Loretz et al. | |
| 8,186,439 | B2 | 5/2012 | Lauderdale | |
| 2003/0047322 | A1 | 3/2003 | Maguire et al. | |
| 2003/0221830 | A1 | 12/2003 | Leising et al. | |
| 2004/0003928 | A1 * | 1/2004 | Frazier | 166/387 |
| 2004/0040705 | A1 * | 3/2004 | Harkins | 166/250.01 |
| 2004/0149429 | A1 | 8/2004 | Dilber et al. | |
| 2004/0216871 | A1 | 11/2004 | Mendez et al. | |
| 2006/0131015 | A1 | 6/2006 | Kanayama et al. | |
| 2007/0181345 | A1 | 8/2007 | Vail, III | |
| 2007/0199176 | A1 | 8/2007 | McClellan | |
| 2007/0261863 | A1 | 11/2007 | Macleod et al. | |
| 2008/0087418 | A1 | 4/2008 | Cook et al. | |
| 2008/0128128 | A1 | 6/2008 | Vail et al. | |
| 2008/0128140 | A1 | 6/2008 | Giroux et al. | |
| 2008/0277117 | A1 | 11/2008 | Burts, Jr. et al. | |
| 2009/0071659 | A1 | 3/2009 | Spencer et al. | |
| 2009/0090508 | A1 | 4/2009 | Brouse | |
| 2009/0139707 | A1 * | 6/2009 | Berzin et al. | 166/118 |
| 2009/0223659 | A1 | 9/2009 | Hill et al. | |

OTHER PUBLICATIONS

Geoplex Wireline, Plugs & Packers, pp. 13-14, Undated but admitted prior art.

ISR and Written Opinion for PCT/US2009/058516 (International Searching Authority—US) Nov. 25, 2009.

ISR and Written Opinion for PCT/US2009/058518 (International Searching Authority—US) Nov. 20, 2009.

ISR and Written Opinion for PCT/US2010/058523 (International Searching Authority—US) Jan. 7, 2010.

ISR and Written Opinion for PCT/US2010/058527 (International Searching Authority—US) Dec. 2, 2009.

Method to Place Elastomer Seals in Boreholes, IP.com (Sep. 1, 2009).

Office Action, U.S. Appl. No. 12/889,394 (Jan. 3, 2013).

Office Action, U.S. Appl. No. 12/889,386 (Jan. 4, 2013).

Office Action, U.S. Appl. No. 12/889,375 (Jan. 31, 2013).

Second Office Action issued by the Mexican Patent Office regarding Mexican Patent Application No. MX/a/2012/003769 dated Dec. 19, 2014 (4 pages) and English translation thereof (5 pages).

* cited by examiner 442
448
446

446
448
444

448
446
442
444

456
452
458
460

456
454
458
460

458
456
452
460
454

THROUGH TUBING BRIDGE PLUG AND INSTALLATION METHOD FOR SAME

CROSS-REFERENCE TO RELATED APPLICATIONS

This application claims the benefit under 35 U.S.C. §119 of the filing date of International Application No. PCT/US2009/058516, filed Sep. 28, 2009. The entire disclosure of this prior application is incorporated herein by this reference.

TECHNICAL FIELD OF THE INVENTION

This invention relates, in general, to equipment utilized in conjunction with operations performed in a subterranean well and, in particular, to a downhole tool that is positioned in a subterranean well to isolate a lower portion of the well from an upper portion of the well.

BACKGROUND OF THE INVENTION

Bridge plugs are well tools that are typically lowered into a cased oil or gas well and set at a desired location inside the casing to isolate pressure between two zones in the well. Retrievable bridge plugs are used during drilling and workover operations to provide a temporary separation of zones. Permanent bridge plugs are used when it is desired to permanently close off the well above a lower zone or formation when, for example, that lower zone has become non-productive but one or more upper zones remain productive. In such cases, a through tubing bridge plug may be installed without the need for pulling the tubing or killing the well. Such through tubing bridge plugs may be lowered through the tubing string on a conveyance such as a wireline, coiled tubing or the like and then set by axially compressing the packing elements of the through tubing bridge plug to expand them into contact with the inner surface of the casing to provide a seal. Once in the sealing configuration, a significant pressure differential can be created across the through tubing bridge plug. Accordingly, conventional through tubing bridge plugs include one or more anchoring assemblies that are designed to support the through tubing bridge plug in the casing. More specifically, the anchoring assemblies are required to hold the through tubing bridge plug in the casing for a sufficient time period to allow cement to be added above the through tubing bridge plug and for the cement to cure to form a permanent plug.

It has been found, however, that the use of through tubing bridge plugs is limited to wells that require only a relatively small expansion ratio between the sealing configuration of the through tubing bridge plug and the running configuration of the through tubing bridge plug. Accordingly, a need has arisen for a through tubing bridge plug that is operable to isolate pressure between two zones in the well. A need has also arisen for such a through tubing bridge plug that is operable to anchor within the casing for a sufficient time period to allow cement to be added and for the cement to cure. Further, a need has arisen for such a through tubing bridge plug that is operable to be installed in wells that require a relatively large expansion ratio between the sealing configuration of the through tubing bridge plug and the running configuration of the through tubing bridge plug.

SUMMARY OF THE INVENTION

The present invention disclosed herein is directed to a through tubing bridge plug that is operable to isolate pressure between two zones in the well. In addition, the through tubing bridge plug of the present invention is operable to anchor within the casing for a sufficient time period to allow cement to be added and for the cement to cure. Further, the through tubing bridge plug of the present invention is operable to be installed in wells that require a relatively large expansion ratio between the gripping and sealing configuration of the through tubing bridge plug and the running configuration of the through tubing bridge plug.

In a first aspect, the present invention is directed to a through tubing bridge plug for providing a gripping and sealing engagement with a casing string of a wellbore. The through tubing bridge plug includes an actuation rod, an anchor assembly disposed about the actuation rod, a pair of compression assemblies disposed about the actuation rod, each including a support assembly and an anti extrusion assembly and a packing assembly disposed about the actuation rod between the compression assemblies. The through tubing bridge plug is operated responsive to longitudinal movement of the actuation rod. This longitudinal movement is operable to actuate the anchor assembly establishing the gripping engagement with the casing string. In addition, this longitudinal movement radially deploys the compression assemblies such that the anti extrusion assemblies are operable to compress the packing assembly. Further, this longitudinal movement is operable to actuate the packing assembly establishing the sealing engagement with the casing string.

In a second aspect, the present invention is directed to a method for establishing a gripping and sealing engagement of a bridge plug with a casing string of a wellbore. The method includes conveying the bridge plug through a tubing string in the wellbore to a target location in the casing string, longitudinally shifting an actuation rod of the bridge plug, radially expanding an anchor assembly of the bridge plug to establish the gripping engagement with the casing string, radially deploying a pair of compression assemblies of the bridge plug such that an anti extrusion assembly of each compression assembly and a support assembly of each compression assembly are deployed and radially expanding a packing assembly disposed about the actuation rod and between the compression assemblies by longitudinally compressing the packing assembly with the compression assemblies to establish the sealing engagement with the casing string.

In a third aspect, the present invention is directed to an actuation assembly for a downhole tool having a tool housing and an actuation member. The actuation assembly includes a downhole power unit having a power unit housing and a moveable shaft. The actuation assembly also includes a stroke extender having an extender housing and an extender mandrel longitudinally movable within the extender housing. The power unit housing is operably associated with the extender housing. The moveable shaft is operably associated with the extender mandrel. The extender housing is operably associated with the tool housing and the actuation member. The extender mandrel is operably associated with the actuation member such that oscillatory movement in first and second longitudinal directions of the moveable shaft relative to the power unit housing causes oscillatory movement in the first and second longitudinal directions of the extender mandrel relative to the extender housing which causes progressive movement in the first direction of the actuation member relative to the tool housing, thereby actuating the downhole tool.

In a fourth aspect, the present invention is directed to a method for actuating a downhole tool having a tool housing and an actuation member. The method involves providing a downhole power unit having a power unit housing and a moveable shaft, providing a stroke extender having an extender housing and an extender mandrel, operably associating the power unit housing with the extender housing and operably associating the moveable shaft with the extender mandrel, operably associating the extender housing with the tool housing and the actuation member and operably associating the extender mandrel with the actuation member, oscillating the moveable shaft in first and second longitudinal directions relative to the power unit housing, oscillating the extender mandrel in the first and second longitudinal directions relative to the extender housing and progressively shifting the actuation member in the first direction relative to the tool housing, thereby actuating the downhole tool.

In a fifth aspect, the present invention is directed to an actuation assembly for setting a through tubing bridge plug having an adaptor and an actuation rod. The actuation assembly includes a downhole power unit having a power unit housing and a moveable shaft. The actuation assembly also includes a stroke extender having a extender housing and an extender mandrel longitudinally movable within the extender housing. The power unit housing is operably associated with the extender housing and the moveable shaft is operably associated with the extender mandrel. The extender housing is operably associated with the adaptor and the actuation rod. The extender mandrel is operably associated with the actuation rod such that oscillatory uphole and downhole movement of the moveable shaft relative to the power unit housing causes oscillatory movement of the extender mandrel relative to the extender housing which shifts the actuation rod in the uphole direction relative to the adaptor, thereby setting the through tubing bridge plug.

In a sixth aspect, the present invention is directed to an anchor assembly for anchoring a downhole tool in a tubular disposed in a wellbore. The anchor assembly includes a first slip assembly having a first sleeve and a plurality of first arms rotatably associated with the first sleeve. The first arms have teeth on an end distal from the first sleeve. A second slip assembly has a second sleeve and a plurality of second arms rotatably associated with the second sleeve. The second arms have teeth on an end distal from the second sleeve. At least one hinge member couples respective first arms with second arms such that the distal ends of respective first and second arms are hingeable relative to one another. The anchor assembly has a running configuration in which the first and second arms are substantially longitudinally oriented and an operating configuration in which respective first and second arms form an acute angle relative to one another such that the teeth of the first and second arms define the radially outermost portion of the anchor assembly.

In an seventh aspect, the present invention is directed to an anchor assembly for anchoring a downhole tool in a tubular disposed in a wellbore. The anchor assembly includes a plurality of slip arm assemblies each including first and second arms hingeably coupled together. The first and second arms each have teeth on one end. A first sleeve is rotatably associated with each of the first arms. A second sleeve is rotatably associated with each of the second arms. The anchor assembly has a running configuration in which the slip arm assemblies are substantially longitudinally oriented and an operating configuration in which the first and second arms of each slip arm assembly form an acute angle relative to one another such that the teeth of the first and second arms define the radially outermost portion of the anchor assembly.

In a eighth aspect, the present invention is directed to a method for operating an anchor assembly to create a gripping engagement with a casing string of a wellbore. The method includes conveying the anchor assembly through a tubing string in the wellbore to a target location in a casing string, applying a compressive force between first and second slip assemblies of the anchor assembly, rotating a plurality of first arms with teeth relative to a first sleeve of the first slip assembly and rotating a plurality of second arms with teeth relative to a second sleeve of the second slip assembly such that the anchor assembly shifts from a running configuration in which the first and second arms are substantially longitudinally oriented to a gripping configuration in which the respective first and second arms form an acute angle relative to one another and the teeth of the first and second arms contact the casing string to establish a gripping engagement therewith.

In a ninth aspect, the present invention is directed to a compression assembly for actuating packing elements of a through tubing bridge plug in a casing string of a wellbore. The compression assembly includes a support assembly having a plurality link arm assemblies each including a short arm pivotably mounted to a long arm. The support assembly has a running configuration in which the link arm assemblies are substantially longitudinally oriented and an operating configuration in which the short arms are pivoted relative to the long arms such that the short arms form a support platform. The compression assembly also includes an anti extrusion assembly that is operably associated with the support assembly. The anti extrusion assembly includes a base member and a plurality of petals rotatably mounted to the base member. The anti extrusion assembly has a running configuration in which the petals are substantially perpendicular to the base member and nested relative to one another and an operating configuration in which the petals are radially outwardly disposed substantially filling gaps between the short arms.

In an tenth aspect, the present invention is directed to an anti extrusion assembly for actuating packing elements of a through tubing bridge plug in a casing string of a wellbore. The anti extrusion assembly includes a base member having a plurality of eccentrically extending pins and a plurality of petals rotatably mounted to the pins of the base member. The anti extrusion assembly has a running configuration in which the petals are substantially perpendicular to the base member and nested relative to one another and an operating configuration in which the petals are rotated such that the petals and the base member substantially lie in the same plane.

In a eleventh aspect, the present invention is directed to a method for actuating packing elements of a bridge plug in a casing string of a wellbore. The method includes conveying the bridge plug through a tubing string in the wellbore to a target location in the casing string, applying a compressive force between a pair of compression assemblies of the bridge plug, operating a support assembly of each compression assembly from a running configuration in which link arm assemblies are substantially longitudinally oriented to an operating configuration in which short arms are pivoted relative to long arms of the link arm assemblies to form a support platform, operating an anti extrusion assembly of each compression assembly from a running configuration in which petals are substantially perpendicular to a base member and nested relative to one another to an operating configuration in which the petals are radially outwardly disposed substantially filling gaps between the short arms and actuating the packing elements into sealing contact with the casing string.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
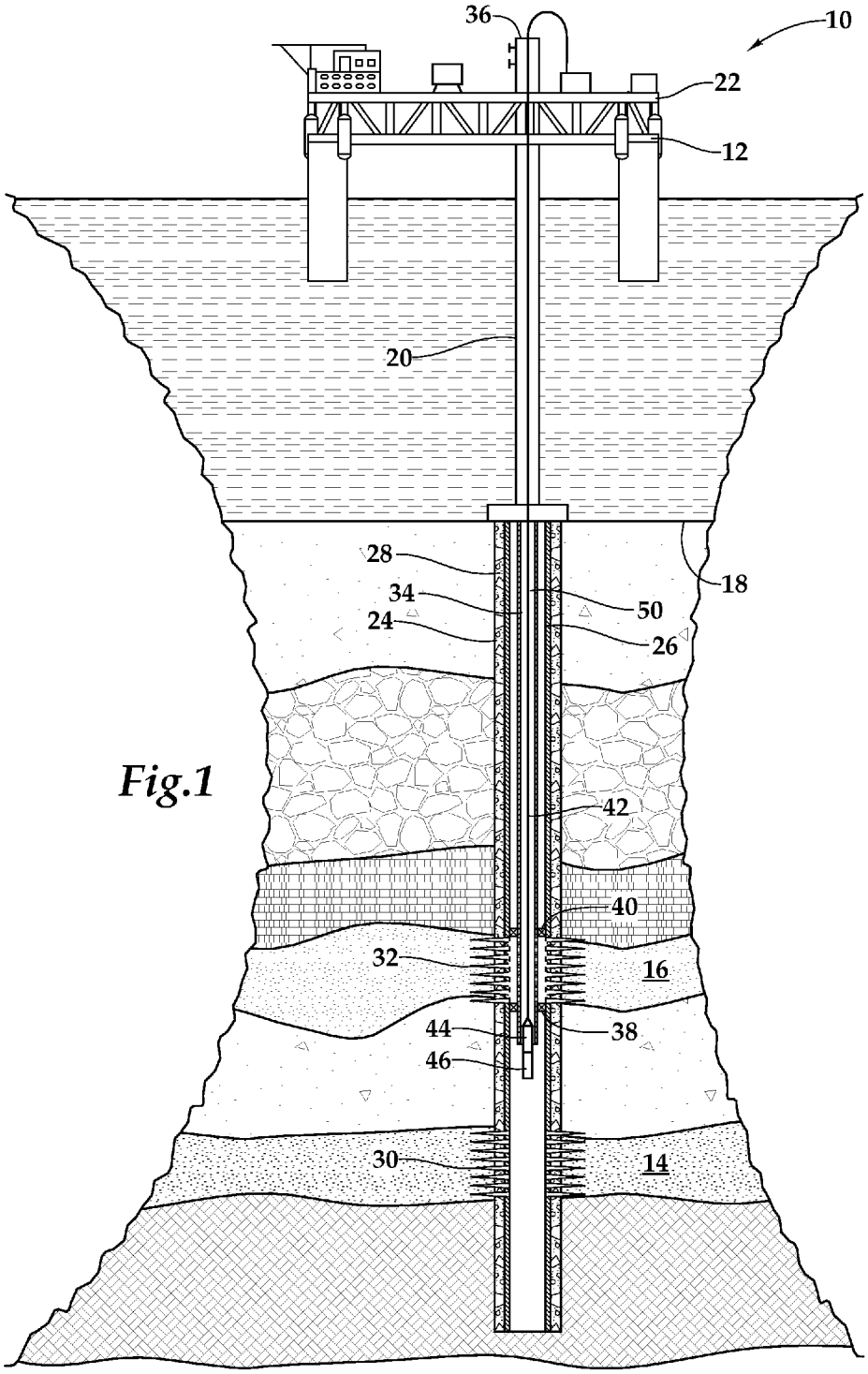
FIG. 1 is a schematic illustration of an offshore oil and gas platform during the installation of a through tubing bridge plug according to an embodiment of the present invention.

Referring initially to FIG. 1, a through tubing bridge plug of the present invention is being installed from an offshore oil and gas platform that is schematically illustrated and generally designated 10. A semi-submersible platform 12 is centered over submerged oil and gas formations 14, 16 located below sea floor 18. A subsea conductor 20 extends from deck 22 of platform 12 to sea floor 18. A wellbore 24 extends from sea floor 18 and traverse formations 14, 16. Wellbore 24 includes a casing 26 that is supported therein by cement 28. Casing 26 has two sets of perforations 30, 32 in the intervals proximate formations 14, 16.

A tubing string 34 extends from wellhead 36 to a location below formation 16 but above formation 14 and provides a conduit for production fluids to travel to the surface. A pair of packers 38, 40 provides a fluid seal between tubing string 34 and casing 26 and directs the flow of production fluids from formation 16 to the interior of tubing string 34 through, for example, a slotted liner. Disposed within tubing string 34 is a wireline 42 used to convey a tool system including a downhole power unit 44 and a through tubing bridge plug 46 as well as a locating device such as a gamma ray tool and other tools (not pictured). Even though downhole power unit 44 and through tubing bridge plug 46 are depicted as being deployed on a wireline, it is to be understood by those skilled in the art that downhole power unit 44 and through tubing bridge plug 46 could be deployed on other types of conveyances, including, but not limited to a slickline, coiled tubing, jointed tubing, a downhole robot or the like, without departing from the principles of the present invention.

In the illustrated embodiment shown FIG. 1, through tubing bridge plug 46 has reached its target location in wellbore 24. As explained in greater detail below, through tubing bridge plug 46 is operated from its running configuration to its gripping and sealing configuration using downhole power unit 44. Downhole power unit 44 transmits a longitudinal force to an actuation rod within through tubing bridge plug 46 via a moveable shaft of downhole power unit 44 such that an anchor assembly of through tubing bridge plug 46 is radially outwardly expanded into gripping contact with casing 26 and a packing assembly of through tubing bridge plug 46 is radially outwardly expanded into sealing contact with casing 26. In one embodiment, through tubing bridge plug 46 may expand from its running configuration having a two and one eighth inch outer diameter to its gripping and sealing configuration in a casing having a seven inch inner diameter. As such both the anchor assembly and the packing assembly of through tubing bridge plug 46 must be operable to have a radial expansion ratio of approximately 3.3 (7 inches divided by 2.125 inches). Even though a specific expansion ratio has been disclosed, other expansion ratios both less than and greater than that specified are also possible using the through tubing bridge plug of the present invention, those expansion ratios including, but not limited to, expansion ratios greater than about between about 2.0, expansion ratios greater than about between about 2.5, expansion ratios greater than about between about 3.0, expansion ratios greater than about between about 3.5 and expansion ratios greater than about between about 4.0.

As will be described in more detail below, a particular implementation of downhole power unit 44 includes an elongated housing, a motor disposed in the housing and a sleeve connected to a rotor of the motor. The sleeve is a rotational member that rotates with the rotor. A moveable member such as the above-mentioned moveable shaft is received within the threaded interior of the sleeve. Operation of the motor rotates the sleeve which causes the moveable shaft to move longitudinally. Accordingly, when downhole power unit 44 is operably coupled with through tubing bridge plug 46 and the moveable member is activated, longitudinal movement is imparted to the actuation rod of through tubing bridge plug 46.

In one implementation, a microcontroller made of suitable electrical components to provide miniaturization and durability within the high pressure, high temperature environments which can be encountered in an oil or gas well is used to control the operation of downhole power unit 44. The microcontroller is preferably housed within the structure of downhole power unit 44, it can, however, be connected outside of downhole power unit 44 but within the associated tool string moved into wellbore 24. In whatever physical location the microcontroller is disposed, it is operationally connected to downhole power unit 44 to control movement of the moveable member when desired. The microcontroller may include a microprocessor which operates under control of a timing device and a program stored in a memory. The program in the memory includes instructions which cause the microprocessor to control the downhole power unit 44.

The microcontroller operates under power from a power supply which can be at the surface or, preferably, contained within the microcontroller, downhole power unit or otherwise within a downhole portion of the tool string of which these components are a part. The power source provides the electrical power to both the motor of downhole power unit 44 and the microcontroller. When downhole power unit 44 is at the target location, the microcontroller commences operation of downhole power unit 44 as programmed. For example, with regard to controlling the motor that operates the sleeve receiving the moveable member, the microcontroller sends a command to energize the motor to rotate the sleeve in the desired direction to either extend or retract the moveable member at the desired speed. One or more sensors monitor the operation of downhole power unit 44 and provide responsive signals to the microcontroller. When the microcontroller determines that a desired result has been obtained, it stops operation of downhole power unit 44, such as by de-energizing the motor. Alternatively, the operation of downhole power unit may be controlled from the surface wherein command signals may be provided to downhole power unit 44 via a wired or wireless communication protocol. Similarly, power may be provided to downhole power unit 44 from the surface via an electrical conductor.

Even though FIG. 1 depicts a vertical well, it should be understood by those skilled in the art that the through tubing bridge plug of the present invention is equally well-suited for use in deviated wells, inclined wells, horizontal wells, multilateral wells and the like. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Likewise, even though FIG. 1 depicts an offshore operation, it should be understood by those skilled in the art that the through tubing bridge plug of the present invention is equally well-suited for use in onshore operations. Also, even though FIG. 1 depicts a cased wellbore, it should be understood by those skilled in the art that the through tubing bridge plug of the present invention is equally well-suited for use in open hole operations.

Figure 2A:
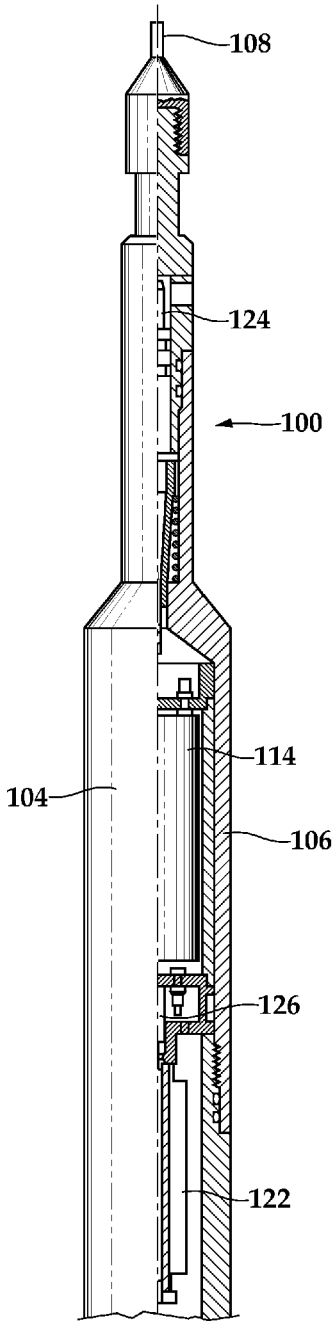
FIGS. 2A-2B are quarter sectional views of successive axial sections of one embodiment of an electromechanical setting tool used for installation of a through tubing bridge plug according to the present invention.
Figure 2B:
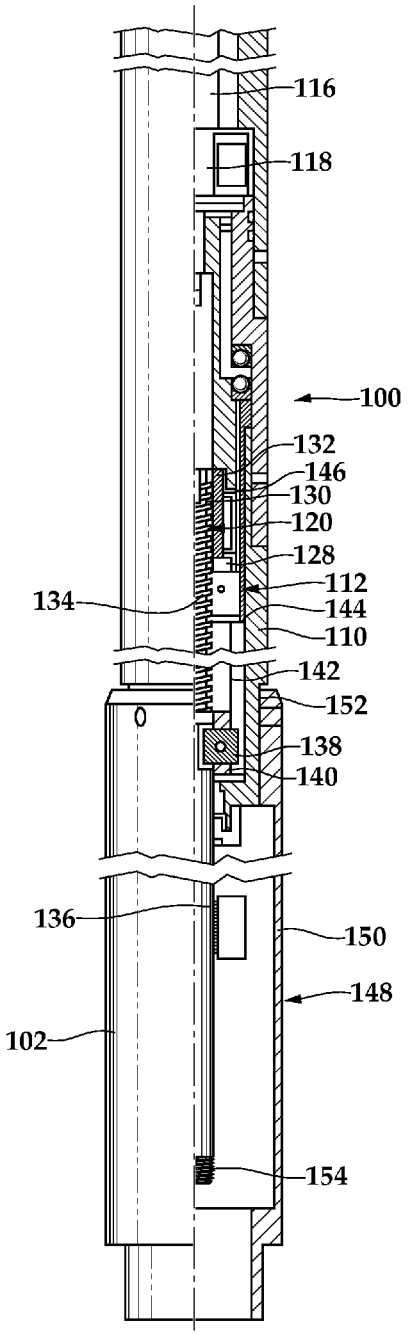
Figure 3A:
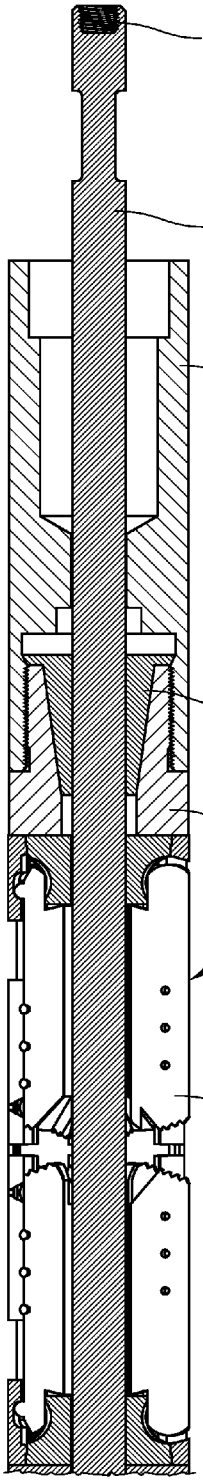
FIGS. 3A-3D are cross sectional views of successive axial sections of one embodiment of a through tubing bridge plug in its running configuration according to the present invention.
Figure 3B:
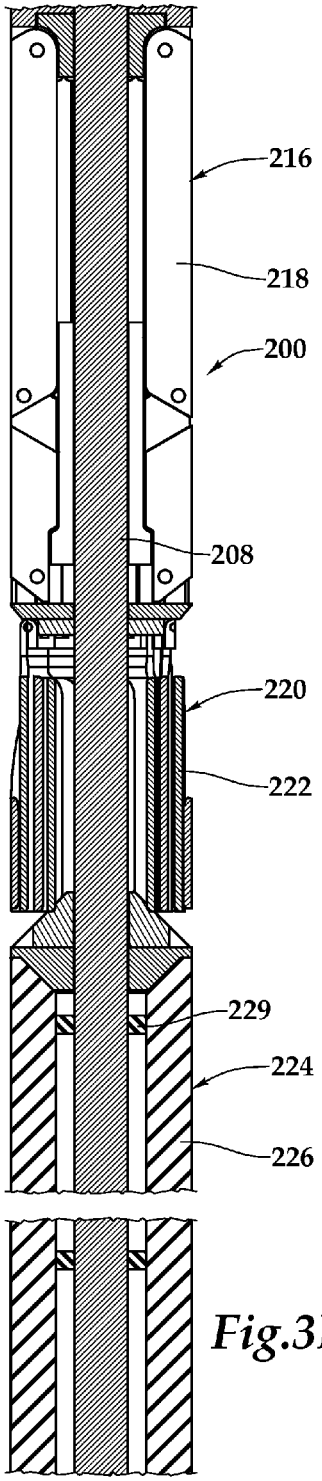
Figure 3C:
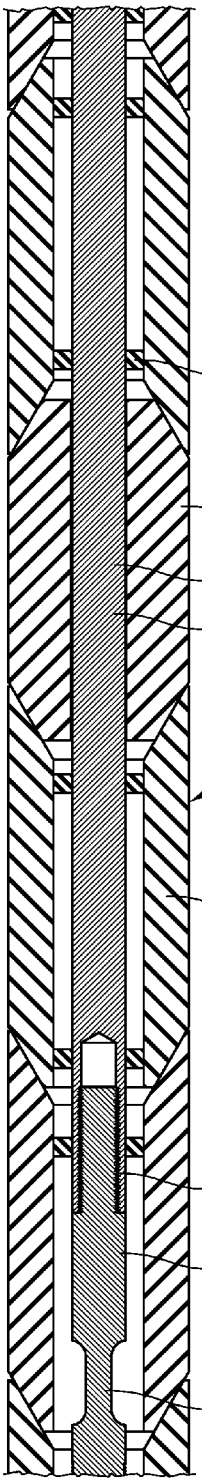
Figure 3D:
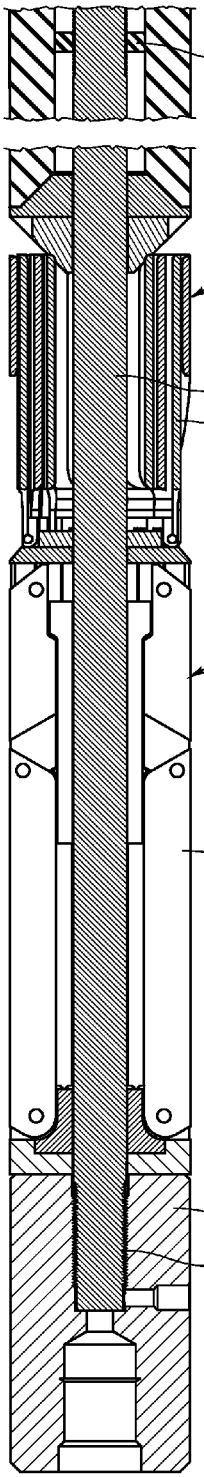

Referring now to FIGS. 2A-2B, therein are depicted successive axial sections of an exemplary downhole power unit that is generally designated 100 and that is capable of operations with the through tubing bridge plug of the present invention. Downhole power unit 100 includes a working assembly 102 and a power assembly 104. Power assembly 104 includes a housing assembly 106 which comprises suitably shaped and connected generally tubular housing members. An upper portion of housing assembly 106 includes an appropriate mechanism to facilitate coupling of housing 106 to a conveyance 108 such as a wireline, slickline, electric line, coiled tubing, jointed tubing or the like. Housing assembly 106 also includes a clutch housing 110 as will be described in more detail below, which forms a portion of a clutch assembly 112.

In the illustrated embodiment, power assembly 104 includes a self-contained power source, eliminating the need for power to be supplied from an exterior source, such as a source at the surface. A preferred power source comprises a battery assembly 114 which may include a plurality of batteries such as alkaline batteries, lithium batteries or the like. Alternatively, however, power may be provided to downhole power unit 100 from the surface via an electrical conductor.

Connected with power assembly 104 is the force generating and transmitting assembly. The force generating and transmitting assembly of this implementation includes a direct current (DC) electric motor 116, coupled through a gearbox 118, to a jackscrew assembly 120. A plurality of activation mechanisms 122, 124 and 126, as will be described, can be electrically coupled between battery assembly 114 and electric motor 116. Electric motor 116 may be of any suitable type. One example is a motor operating at 7500 revolutions per minute (rpm) in unloaded condition, and operating at approximately 5000 rpm in a loaded condition, and having a horsepower rating of approximately 1/30th of a horsepower. In this implementation, motor 116 is coupled through the gearbox 118 which provides approximately 5000:1 gear reduction. Gearbox 118 is coupled through a conventional drive assembly 128 to jackscrew assembly 120.

Jackscrew assembly 120 includes a threaded shaft 130 which moves longitudinally, rotates or both, in response to rotation of a sleeve assembly 132. Threaded shaft 130 includes a threaded portion 134, and a generally smooth, polished lower extension 136. Threaded shaft 130 further includes a pair of generally diametrically opposed keys 138 that cooperate with a clutch block 140 which is coupled to threaded shaft 130. Clutch housing 110 includes a pair of diametrically opposed keyways 142 which extend along at least a portion of the possible length of travel. Keys 138 extend radially outwardly from threaded shaft 130 through clutch block 140 to engage each of keyways 142 in clutch housing 110, thereby selectively preventing rotation of threaded shaft 130 relative to housing 110.

Rotation of sleeve assembly 132 in one direction causes threaded shaft 130 and clutch block 140 to move longitudinally upwardly relative to housing assembly 110 if shaft 130 is not at its uppermost limit. Rotation of the sleeve assembly 132 in the opposite direction moves shaft 130 downwardly relative to housing 110 if shaft 130 is not at its lowermost position. Above a certain level within clutch housing 110, as indicated generally at 144, clutch housing 110 includes a relatively enlarged internal diameter bore 146 such that moving clutch block 140 above level 144 removes the outwardly extending key 138 from being restricted from rotational movement. Accordingly, continuing rotation of sleeve assembly 132 causes longitudinal movement of threaded shaft 130 until clutch block 140 rises above level 144, at which point rotation of sleeve assembly 132 will result in free rotation of threaded shaft 130. By virtue of this, clutch assembly 112 serves as a safety device to prevent burn-out of the electric motor, and also serves as a stroke limiter. In a similar manner, clutch assembly 112 may allow threaded shaft 130 to rotation freely during certain points in the longitudinal travel of threaded shaft 130.

In the illustrated embodiment, downhole power unit 100 incorporates three discrete activation assemblies, separate from or part of the microcontroller discussed above. The activation assemblies enable jackscrew 120 to operate upon the occurrence of one or more predetermined conditions. One depicted activation assembly is timing circuitry 122 of a type known in the art. Timing circuitry 122 is adapted to provide a signal to the microcontroller after passage of a predetermined amount of time. Further, downhole power unit 100 can include an activation assembly including a pressure-sensitive switch 124 of a type generally known in the art which will provide a control signal, for example, once the switch 124 reaches a depth at which it encounters a predetermined amount of hydrostatic pressure within the tubing string or experiences a particular pressure variation or series of pressure variations. Still further, downhole power unit 100 can include a motion sensor 126, such as an accelerometer or a geophone that is sensitive to vertical motion of downhole power unit 100. Accelerometer 126 can be combined with timing circuitry 122 such that when motion is detected by accelerometer 126, timing circuitry 122 is reset. If so configured, the activation assembly operates to provide a control signal after accelerometer 126 detects that downhole power unit 100 has remained substantially motionless within the well for a predetermined amount of time.

Working assembly 102 includes an actuation assembly 148 which is coupled through housing assembly 106 to be movable therewith. Actuation assembly 148 includes an outer sleeve member 150 which is threadably coupled at 152 to housing assembly 106. Threaded shaft 130 extends through actuation assembly 148 and has a threaded end 154 for coupling to other tools such as a stroke extender or a through tubing bridge plug as will be described below.

In operation, downhole power unit 100 is adapted to cooperate directly with a through tubing bridge plug or indirectly with a through tubing bridge plug via a stroke extender depending upon the particular implementation. Specifically, prior to run in, outer sleeve member 150 of downhole power unit 100 is operably associated with a mating tubular of a stroke extender or a through tubing bridge plug as described below. Likewise, shaft 130 of downhole power unit 100 is operably associated with a mating component of a stroke extender or a through tubing bridge plug as described below. As used herein, the term operably associated with shall encompass direct coupling such as via a threaded connection, a pinned connection, a frictional connection, a closely received relationship and may also including the use of set screws or other securing means. In addition, the term operably associated with shall encompass indirect coupling such as via a connection sub, an adaptor or other coupling means. As such, an upward longitudinal movement of threaded shaft 130 of downhole power unit 100 exerts an upward longitudinal force upon the component to which it is operably associated that initiates the operation of either a stroke extender or a through tubing bridge plug that is associated therewith as described below.

As will be appreciated from the above discussion, actuation of motor 116 by activation assemblies 122, 124, 126, and control of motor 116 by the microcontroller results in the required longitudinal movement of threaded shaft 130. In the implementation wherein a stroke extender is used, threaded shaft 130 is only required to move a reciprocate short distance in the upward direction followed by a relatively short distance in the downward direction for the number of strokes necessary to install the through tubing bridge plug. In the implementation wherein a stroke extender is not used, threaded shaft 130 is required to move a relative long distance in the upward direction to install the through tubing bridge plug. In either case, downhole power unit 100 may be preprogrammed to perform the proper operations prior to deployment into the well. Alternatively, downhole power unit 100 may receive power, command signals or both from the surface via an umbilical cord. Once the through tubing bridge plug is installed, downhole power unit 100 and the stroke extender, if present, may be retrieved to the surface.

Even though a particular embodiment of a downhole power unit has been depicted and described, it should be clearly understood by those skilled in the art that other types of downhole power devices could alternatively be used with the through tubing bridge plug of the present invention such that the through tubing bridge plug of the present invention may establish a gripping and sealing relationship with the interior of a downhole tubular.

Referring now to FIGS. 3A-3D therein is depicted successive axial sections of one embodiment of a through tubing bridge plug in its running configuration that is generally designated 200. Through tubing bridge plug 200 includes an upper adaptor 202 that is designed to cooperate with the lower end of a downhole power unit described above or the lower end of a stroke extender described below. Upper adaptor 202 is threadably coupled to a slip housing 204. Positioned within slip housing 204 is a plurality of slip members 206 that selectively grip an actuation member depicted as actuation rod 208. At its upper end, actuation rod 208 has a threaded opening 210 that is designed to cooperate with moveable shaft 130 of a downhole power unit described above. Positioned below slip housing 204 is an anchor assembly 212. As described in greater detail below, anchor assembly 212 includes five hingeable slip arms 214, only two of which are visible in FIG. 3A, that provide a gripping relationship with the casing wall upon deployment. Even though a particular number of hingeable slip arms has been described in the present embodiment, it is to be understood by those skilled in the art that other numbers of hingeable slip arms both greater than and less than that specified are possible and are considered to be within the scope of the present invention.

Positioned below anchor assembly 212 is a support assembly 216. As described in greater detail below, support assembly 216 includes ten hingeable support arms 218, only two of which are visible in FIG. 3A, that maintain through tubing bridge plug 200 in the center of the wellbore during the setting process. Operably associated with support assembly 216 is an anti extrusion assembly 220 that includes ten rotatably mounted petals 222 that are supported by support arms 218 and substantially fill a cross section of the wellbore upon deployment. Even though a particular number of hingeable support arms and petals have been described in the present embodiment, it is to be understood by those skilled in the art that other numbers of hingeable support arms and petals both greater than and less than that specified are possible and are considered to be within the scope of the present invention. Preferably, however, the number of hingeable support arms and the number of petals are the same.

Positioned below anti extrusion assembly 220 is a packing assembly 224. Packing assembly 224 includes a plurality of packing elements 226 that are preferably formed from a polymer material such as an elastomer, a thermoplastic, a thermoset or the like. In the illustrated embodiment, packing elements 226 are directionally arranged about a center element 228 to aid in the predictability of the expansion of packing assembly 224 upon activation of through tubing bridge plug 200. As illustrated, center element 228 is closely received around actuation rod 208. In addition, center element 228 has beveled ends such that its outermost portions have a radially reduced outer diameter. The other packing elements 226 have a spaced apart relationship with actuation rod 208 and also have beveled ends, however, one end is concave and one end is convex to enable nesting of packing elements 226 during run in and longitudinal movement relative to one another during installation. In the illustrated embodiment, one or more washers or centralizers 229 are positioned in the area between actuation rod 208 and the interior of packing elements 226. Centralizers 229 are preferably formed from a polymer material such as an elastomer, a thermoplastic, a thermoset or the like including swellable polymers such as those described below. Use of centralizers 229 further enhances the predictability of the expansion of packing assembly 224.

Actuation rod 208 includes an upper section 230 and a lower section 232 that are threadably coupled together at 234. Lower section 232 has a radially reduced section 236 that enables retrieval of the downhole power unit and upper portion 230 of actuation rod 208 after installation of through tubing bridge plug 200. Positioned below packing assembly 224 is an anti extrusion assembly 238. Anti extrusion assembly 238 includes ten rotatably mounted petals 240 that operate like those discussed above. Operably associated with anti extrusion assembly 238 is a support assembly 242 that includes ten hingeable support arms 244, only two of which are visible in FIG. 3D, that operate like those discussed above. Positioned below support assembly 242 is an end cap 246 that is securably coupled to lower section 232 of actuation rod 208 at a threaded connection 248.

In operation, a tool string including through tubing bridge plug 200 is run to its target location in the wellbore through the tubing string on a conveyance. The tool string may include a plurality of tools, for example, a locating device such as a gamma ray tool and an electromechanical setting device such as downhole power unit 100. Specifically, the upper end of upper adaptor 202 of through tubing bridge plug 200 is operable to receive the lower end of outer sleeve member 150 of downhole power unit 100. In addition, actuation rod 208 of through tubing bridge plug 200 is threadably coupled to shaft 130 of downhole power unit 100 such that through tubing bridge plug 200 and downhole power unit 100 are secured together. Once through tubing bridge plug 200 is properly positioned in the desired location in the casing string, the activation process may begin.

Figure 4A:
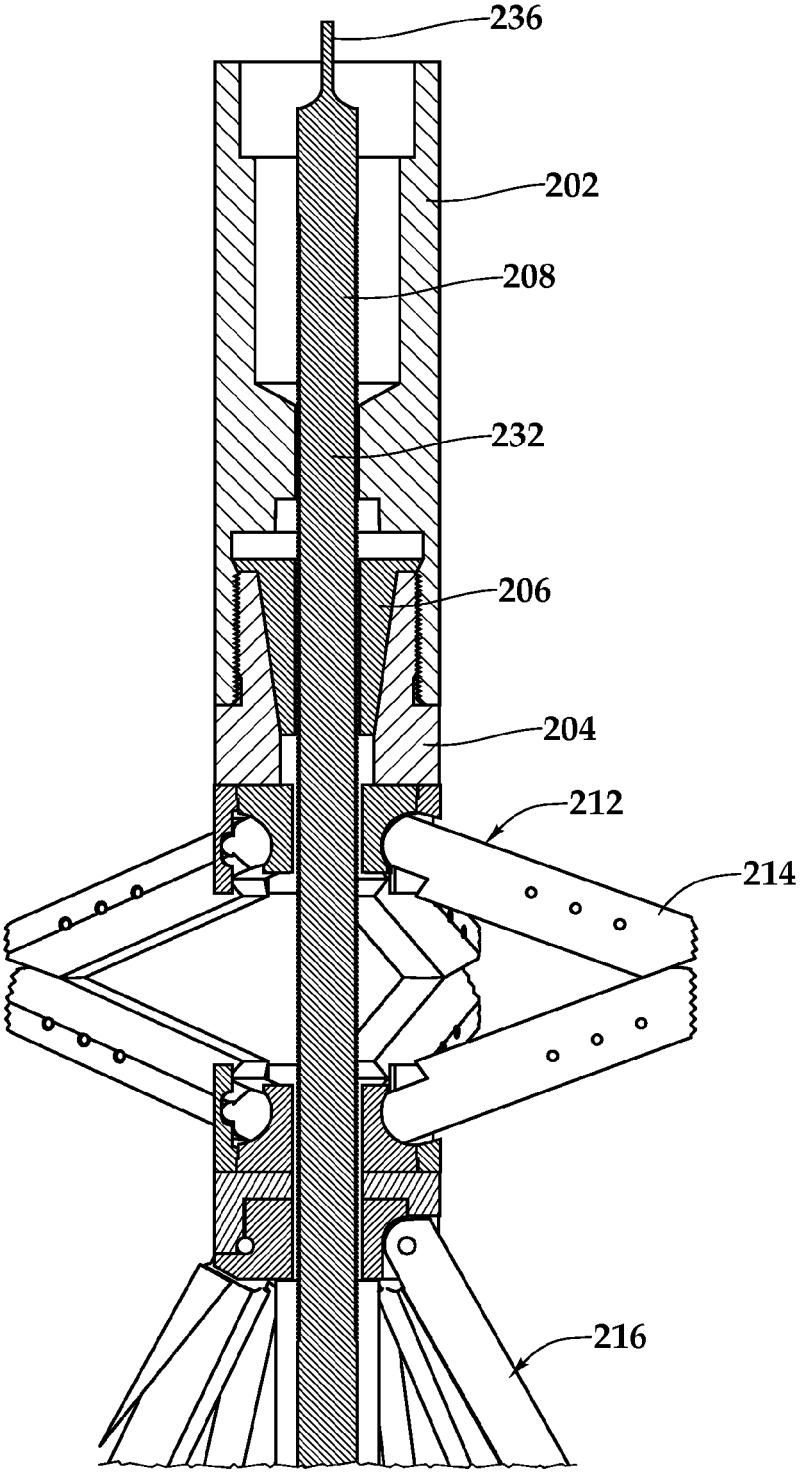
FIGS. 4A-4B are cross sectional views of one embodiment of a through tubing bridge plug in its gripping and sealing configuration according to the present invention.
Figure 4B:
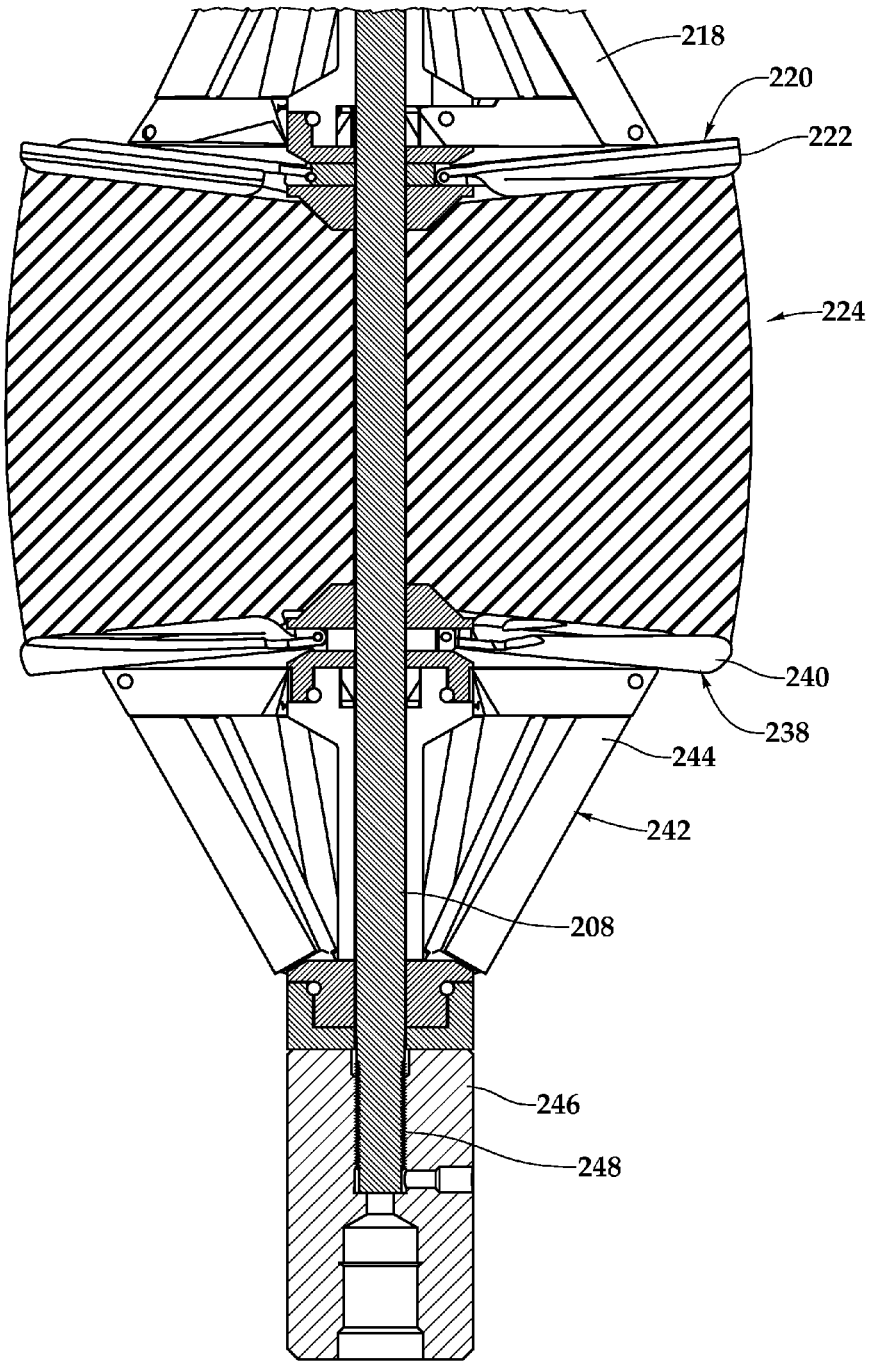

Through tubing bridge plug 200 is operated from its running configuration, as best seen in FIGS. 3A-3D, to its gripping and sealing configuration, as best seen in FIGS. 4A-4B, by downhole power unit 100. This is achieved by moving shaft 130 upwardly which in turn causes actuation rod 208 to move upwardly, carrying with it end cap 246. This upward movement generally compresses through tubing bridge plug 200 as its upper end is fixed against downhole power unit 100. More specifically, this upward movement causes slip arms 214 of anchor assembly 212 to radially outwardly expand into contact with the casing wall creating a gripping engagement therewith. In addition, this upward movement causes support arms 218, 244 of support assemblies 216, 242 and petals 222, 240 of anti extrusion assemblies 220, 238 to radially outwardly expand to a location proximate to the surface of the casing wall. As actuation rod 208 continues to travel upwardly packing elements 226 are longitudinally compressed and radially expanded into contact with the casing wall creating a sealing engagement therewith.

One of the benefits of the present invention is that the process of longitudinally compressing and radially expanding packing elements 226 is a controlled process that proceeds slowly compared to prior art hydraulic and explosive setting techniques. The controlled nature of this process allows packing elements 226 to deform in a more uniform manner and to move relative to one another such that stress concentrations and extrusion can be avoided. In addition, the use of support assemblies 216, 242 and anti extrusion assemblies 220, 238 further enhance the control over the movement of packing elements 226. Once packing elements 226 are fully compressed, upward movement of actuation rod 208 ceases. During this process, slip members 206 allow for the upward movement of actuation rod 208 but prevent any downward movement of actuation rod 208 after through tubing bridge plug 200 is set in the casing. Continued upward movement of shaft 130 then causes radially reduced section 236 of actuation rod 208 to fail in tension. At this point, through tubing bridge plug 200 is fully installed and has established a gripping and sealing relationship with the casing. Thereafter, downhole power unit 100 and upper portion 230 of actuation rod 208 may be retrieved to the surface and, in a permanent bridge plug implementation, cement may be placed above through tubing bridge plug 200 to permanently plug the well. Alternatively, in a temporary bridge plug implementation, the sealing and gripping relation of through tubing bridge plug 200 with the casing is suitable to provide the desired plugging function.

Figures 5A, 5B, 5C:
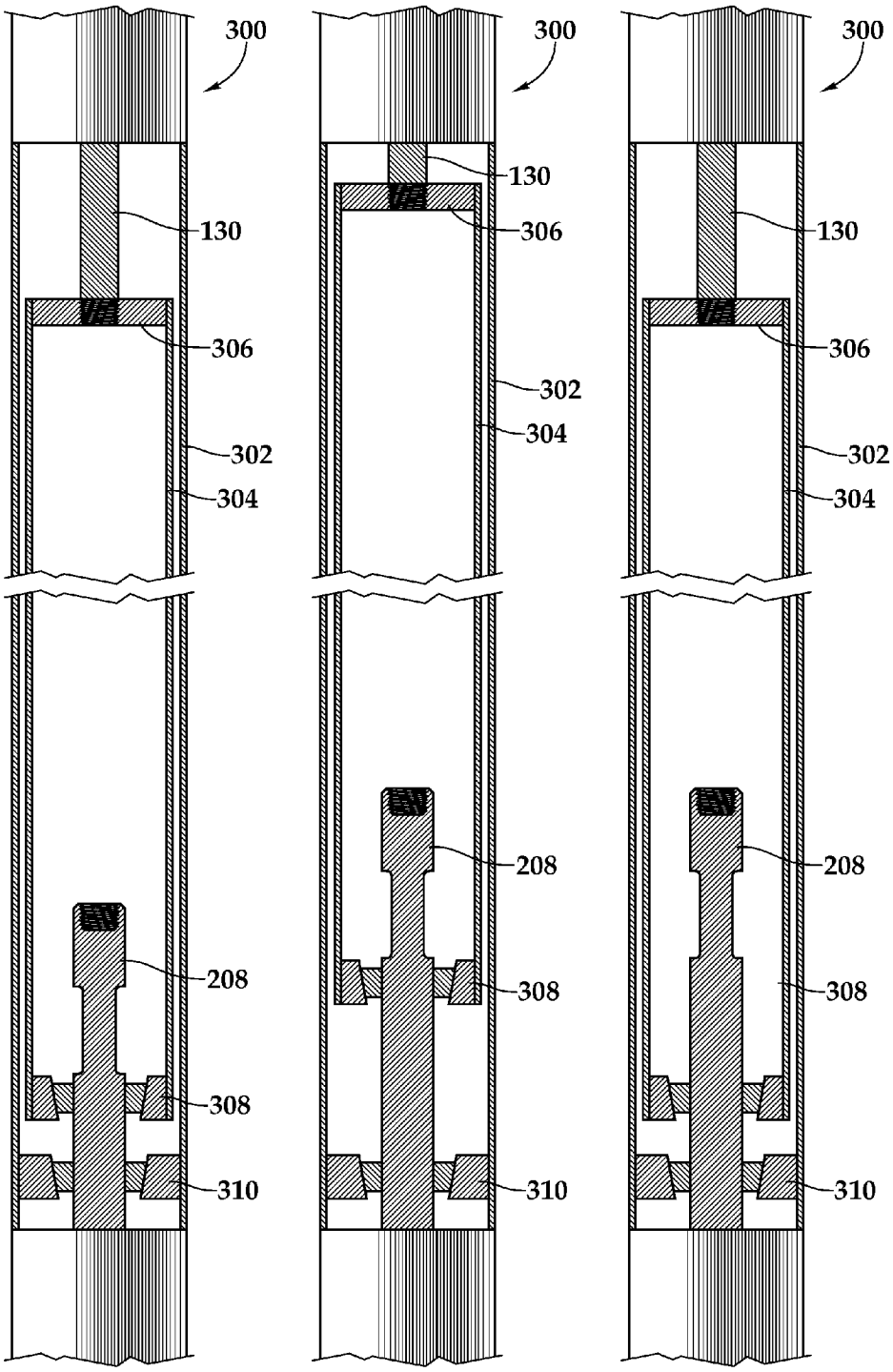
FIGS. 5A-5C are cross sectional views partial in cut away of one embodiment of a stroke extender positionable between a downhole power unit and a through tubing bridge plug according to the present invention in sequential operating positions.

In certain implementations wherein the expansion ratio of through tubing bridge plug 200 is relatively large, the length of packing assembly 224 must be relative long. In the embodiment discussed above wherein the through tubing bridge plug expands from a two and one eighth inch outer diameter running configuration to a seven inch outer diameter gripping and sealing configuration, the length of the packing assembly 224 may be six feet or more. In such cases, if downhole power unit 100 is used to directly move actuation rod 208, downhole power unit 100 would need to be at least three times the length of the desired compression of packing assembly 224 or in this case about twenty feet long. In certain situations, it may be undesirable to have a downhole power unit of that length. As best seen in FIGS. 5A-5C, a stroke extender may be placed between downhole power unit 100 and through tubing bridge plug 200 to reduce the overall length of the tool system and particularly the length of downhole power unit 100.

Stroke extender 300 includes an outer housing 302 that is operable to receive the lower end of outer sleeve member 150 of downhole power unit 100. Preferably, stroke extender 300 and downhole power unit 100 are securably coupled together using pins, set screws, a threaded connection or the like. The upper end of upper adaptor 202 of through tubing bridge plug 200 is operable to receive the lower end of outer housing 302 of stroke extender 300. Stroke extender 300 includes an extender mandrel depicted as an actuation tubular 304 that is longitudinally movable within outer housing 302. Actuation tubular 304 has an upper connector 306 that is threadably coupled to shaft 130 of downhole power unit 100. Actuation tubular 304 also includes a set of one way slips 308 that are operably to selectively secure actuation rod 208 therein. Likewise, a set of one way slips 310 is disposed within outer housing 302 to selectively secure actuation rod 208 therein.

In operation, stroke extender 300 allows for the use of a downhole power unit 100 with a stroke that is shorter than the required compression length of packing assembly 224. Specifically, once the tool string including downhole power unit 100, stroke extender 300 and through tubing bridge plug 200 is at the target location in the wellbore, oscillatory operation of downhole power unit 100 may be used to install through tubing bridge plug 200.

As best seen in FIG. 5A, actuation rod 208 of through tubing bridge plug 200 is being supported by one way slips 310, which prevent downward movement of actuation rod 208. As shaft 130 of downhole power unit 100 is moved up, as best seen in FIG. 5B, one way slips 308 are operable to lift actuation rod 208 in the upward direction as one way slips 310 provide little or no resistance to movement in this direction. Once shaft 130 completes its upward stroke, the motor of downhole power unit 100 may be reversed to cause shaft 130 to travel in the opposite direction, as best seen in FIG. 5C. During the downward stroke, one way slips 310 prevent downward movement of actuation rod 208 and one way slips 308 are operable to travel downhole around actuation rod 208 with little or no resistance to movement. This process is repeated until through tubing bridge plug 200 is operated from its running configuration, as best seen in FIGS. 3A-3D, to its gripping and sealing configuration, as best seen in FIGS. 4A-4B, in the manner described above.

In certain embodiments, instead of reversing the motor of downhole power unit 100 to enable a down stroke, a clutch may be operated such that shaft 130 may be mechanically or hydraulically shifted downwardly without motor operation, thereby reducing the duration of the down stroke. One of the benefits of using a stroke extender is the ease of adjusting its length. This is achieved by adding or removing tubular sections from outer housing 302 and actuation tubular 304. This modularity of stroke extender 300 eliminates the need to have different downhole power units of the same outer diameter with different stroke lengths.

Even though a particular embodiment of a stroke extender has been depicted and described, it should be clearly understood by those skilled in the art that other types of stroke extenders could alternatively be used in conjunction with the downhole power unit and through tubing bridge plug without departing from the principles of the present invention.

Figure 6A:
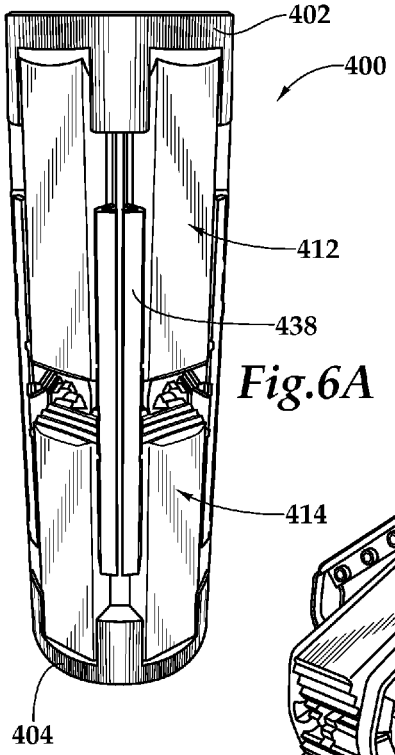
FIGS. 6A-6C are various views of an anchor assembly for use in a through tubing bridge plug according to one embodiment of the present invention.
Figure 6B:
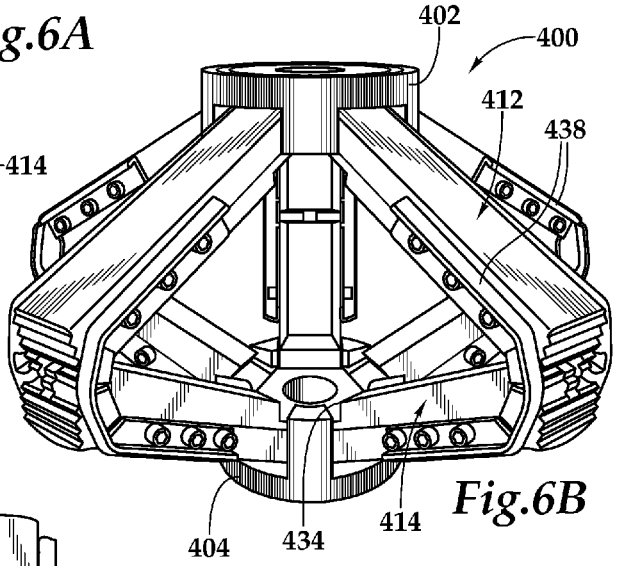
Figure 6C:
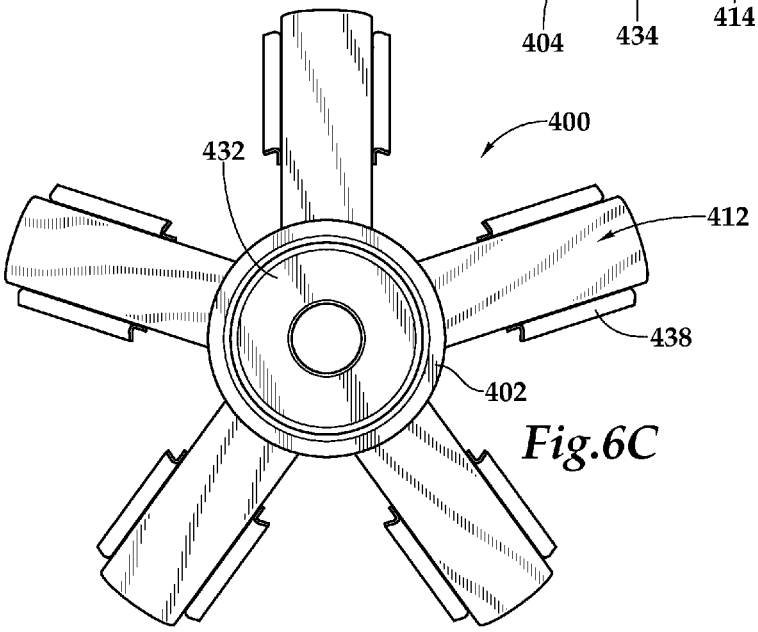
Figure 6D:
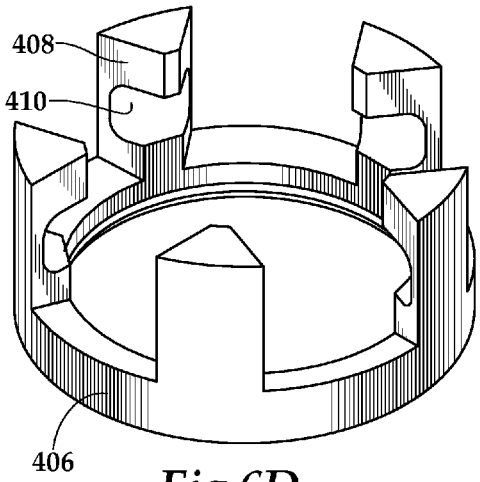
FIGS. 6D-6H are various component parts of an anchor assembly for use in a through tubing bridge plug according to an embodiment of the present invention.
Figure 6E:
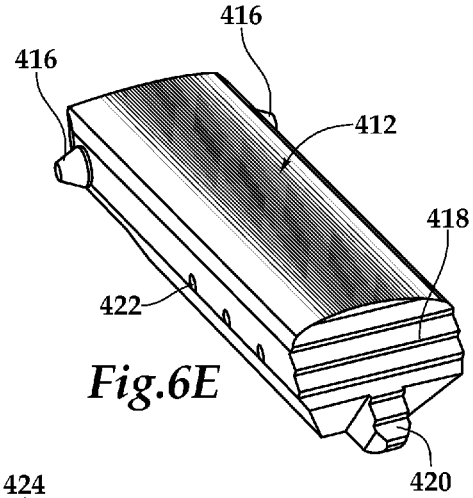
Figure 6F:
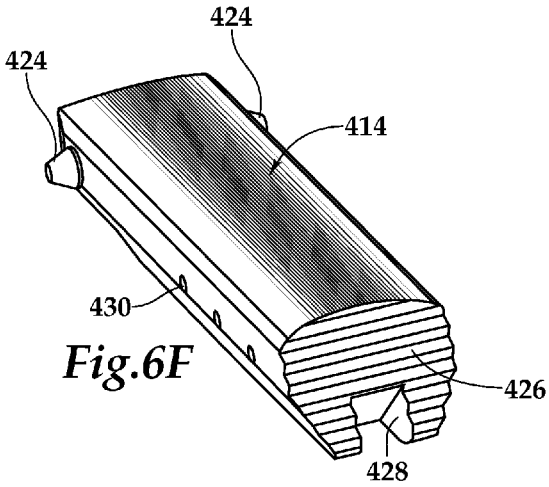

Referring next to FIGS. 6A-6H, therein are depicted various views of an anchor assembly and its component parts that is operable for use in a through tubing bridge plug of the present invention and that is generally designated 400. Anchor assembly 400 includes an upper sleeve 402 and a lower sleeve 404. As best seen in FIG. 6D, each sleeve includes a cylindrical section 406 and five extensions 408 each having a receiving slot 410 on an inner surface thereof. Anchor assembly 400 also includes a set of five upper slip arms 412 and a set of five lower slip arms 414. As best seen in FIG. 6E, each upper slip arm 412 includes a pair of oppositely disposed pivot members 416 that are designed to be received within adjacent receiving slots 410 of upper sleeve 402. Each upper slip arm 412 also includes a plurality of teeth 418 and a pin end 420. In the illustrated embodiment, upper slip arm 412 further includes a plurality threaded openings 422 on each side thereof, only the three on the left side being visible in FIG. 6E. As best seen in FIG. 6F, each lower slip arm 414 includes a pair of oppositely disposed pivot members 424 that are designed to be received within adjacent receiving slots 410 of lower sleeve 402. Each lower slip arm 414 also includes a plurality of teeth 426 and a socket end 428. In the illustrated embodiment, lower slip arm 414 further includes a plurality threaded openings 430 on each side thereof, only the three on the left side being visible in FIG. 6F.

Figure 6G:
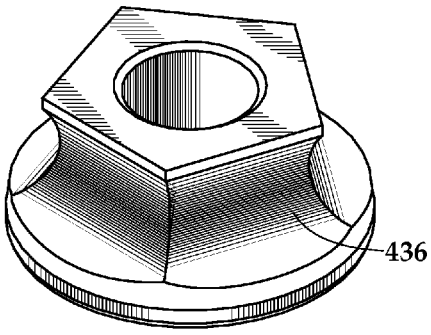

Anchor assembly 400 further includes an upper base member 432, visible in FIG. 6C, and lower base member 434, visible in FIG. 6B. As best seen in FIG. 6G, each base member includes five rotational surfaces 436, one for each of the respective slip arms that rotates relative thereto during operation of anchor assembly 400. Each base member is received within the central opening of a cylindrical section 406 of a sleeve. In this configuration, base members not only provide rotational surfaces 434 for the slip arms but also lock the pivot members of the slip arms within the receiving slots of the sleeve extensions. In this manner, an upper sleeve 402, an upper base member 432 and the set of five upper slip arms 412 may be considered an upper slip assembly. Likewise, a lower sleeve 404, a lower base member 434 and the set of five lower slip arms 414 may be considered a lower slip assembly.

Figure 6H:
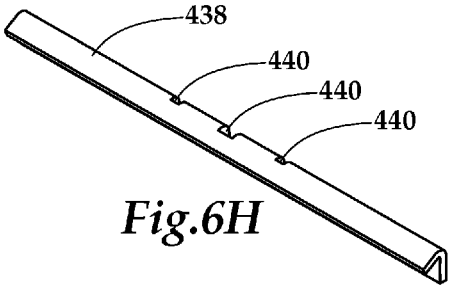
Figures 6I, 6J, 6K, 6L, 6M, 6N:
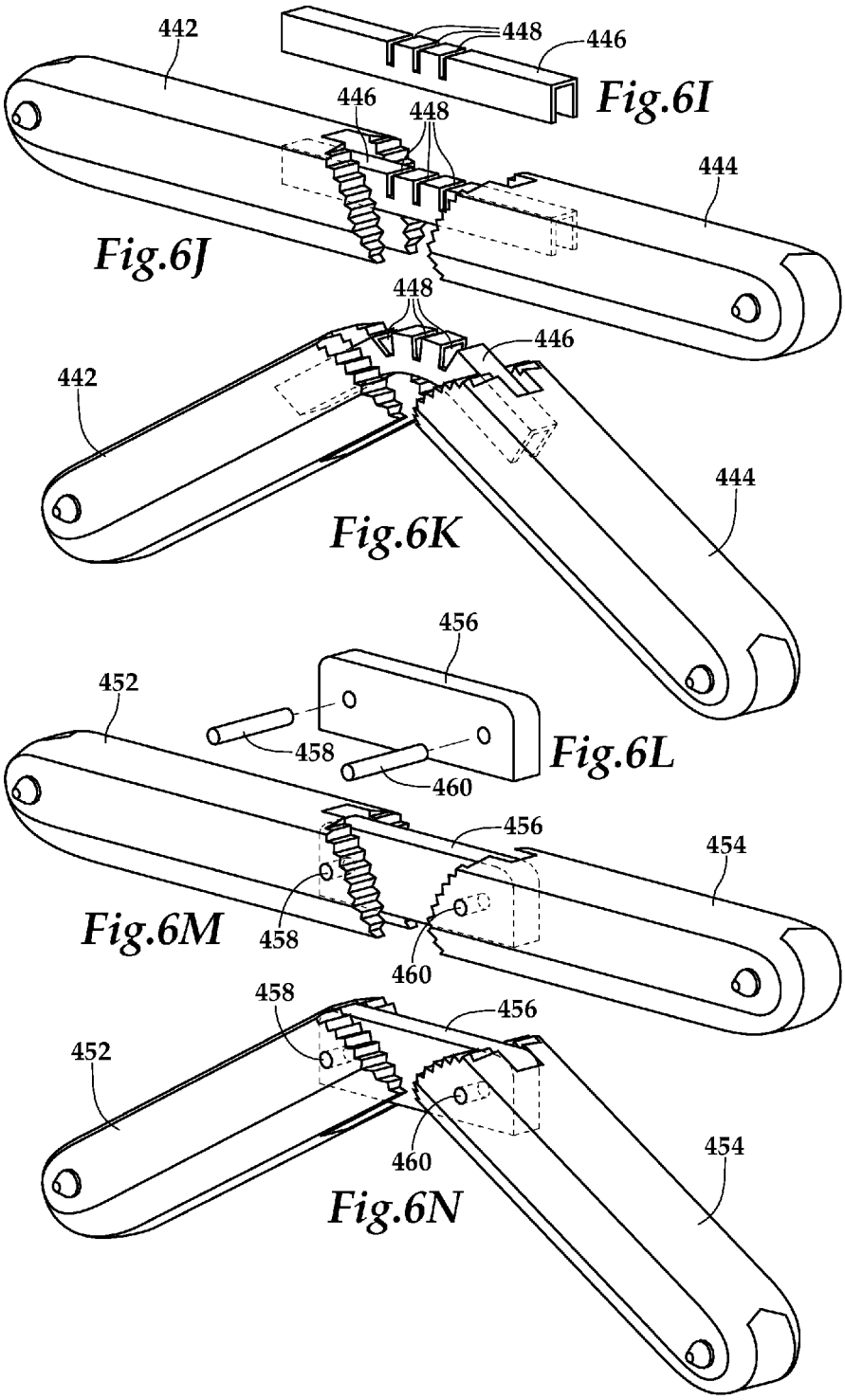
FIGS. 6I-6N are various component parts of alternate embodiments of an anchor assembly for use in a through tubing bridge plug according to an embodiment of the present invention.

One or more hinge members are used to connect an upper anchor assembly with a lower anchor assembly. In the illustrated embodiment, adjacent upper and lower slip arms 412, 414 are operably coupled together with two hinge members 438. In this manner, an upper slip arm 412, a pair of hinge members 438 and a lower slip arm 414 may be considered a slip arm assembly. Hinge members 438 are secured to each of the upper and lower slip arms 412, 414 with a plurality of fasteners depicted as three bolts. Even though bolts have be shown as fastening hinge members 438 to the upper and lower slip arms 412, 414, those skilled in the art will understand that other fastening techniques could alternatively be used, including, but not limited to, pins, rivets, welding and the like. As best seen in FIG. 6H, hinge members 438 are formed from in-line metal angles having a V shape and include a plurality of notches 440 that provide preferential bending locations to guide upper and lower slip arms 412, 414 during actuation. In an alternative embodiment, as best seen in FIGS. 6I-6K, adjacent upper and lower slip arms 442, 444 are operably coupled together with a single hinge member 446. In this embodiment, each hinge member 446 is inserted into a complementary opening in each of the upper and lower slip arms 442, 444 and may be secured therein with a fastening device or held in place with compression. Each hinge member 446 is formed from an in-line metal angle having a U shape and includes a plurality of notches 448 that provide preferential bending locations to guide upper and lower slip arms 442, 444 during actuation. In another alternative embodiment, as best seen in FIGS. 6L-6N, adjacent upper and lower slip arms 452, 454 are operably coupled together with a rotatable hinge member 456. In this embodiment, each hinge member 456 is inserted into a slot in each of the upper and lower slip arms 452, 454 and is secured therein with pins 458, 460, respectively, that provide for relative rotation therebetween during actuation.

In operation and referring again to the primary embodiment, as downhole power unit 100 is operated to actuate through tubing bridge plug 200 as described above, anchor assembly 400 is operated from its small diameter running configuration, wherein the outer surfaces of adjacent upper and lower slip arms 412, 414 lie substantially in the same plane such that upper and lower slip arms 412, 414 are substantially longitudinally oriented (see FIG. 6A) to its large diameter gripping configuration, wherein upper and lower slip arms 412, 414 form an acute angle relative to one another and teeth 418, 426 contact the casing wall (see FIGS. 6B-6C). More specifically, a compressive force is generated between upper sleeve 402 and lower sleeve 404. This compressive force is transferred to hinge members 438 via upper and lower slip arms 412, 414. Notches 440 in hinge members 438 preferentially create bending locations that cause the lower ends of upper slip arms 412 and the upper ends of lower slip arms 414 to move radially outwardly. At the same time, the upper ends of upper slip arms 412 rotate about pivot members 416 and the top surfaces of upper slip arms 412 rotate against rotational surfaces 436 of upper base member 432. Likewise, the lower ends of lower slip arms 414 rotate about pivot members 424 and the bottom surfaces of lower slip arms 414 rotate against rotational surfaces 436 of lower base member 434. This rotational motion continues until pin ends 420 of upper slip arms 412 are received within socket ends 428 of lower slip arms 414 and teeth 418, 426 of upper and lower slip arms 412, 414 have engaged the casing wall. In this configuration, anchor assembly 400 has created a gripping relationship with the casing wall to secure through tubing bridge plug 200 therein.

Even though a particular embodiment of an anchor assembly has been depicted and described, it should be clearly understood by those skilled in the art that other types of anchor assemblies could alternatively be used in conjunction with the downhole power unit and through tubing bridge plug without departing from the principles of the present invention. Likewise, the anchor assembly of the present invention could be used to secure other devises within a wellbore Referring next to FIGS. 7A-7G, therein are depicted various views of a compression assembly and component parts thereof that are operable for use in a through tubing bridge plug of the present invention and that are generally designated 500. Compression assembly 500 includes a support assembly 502 and anti extrusion assembly 504 that cooperate to compress packing assembly 224 of through tubing bridge plug 200 during actuation and sealing against the casing without allowing extrusion of packing assembly 224. In the illustrated embodiment, support assembly 502 includes an upper cover 506 having a cylindrical section 508 and ten extensions 510. Support assembly 502 also includes an upper backup member 512. Positioned below upper backup member 512 are ten upper link arms 514. Upper link arms 514 include pin ends 516 that are received between and rotatably supported by upper backup member 512 and upper cover 506. Upper link arms 514 also include slot ends 518. Positioned below upper link arms 514 are ten lower link arms 520. Lower link arms 520 include pin ends 522 each of which are received within a slot end 518 of an adjacent upper link arm 514 and are rotatably supported therein. Lower link arms 520 also include pin ends 524. As illustrated, lower link arms 520 are longer than upper link arms 514. At its lower end, support assembly 502 includes a lower cover 526 having a cylindrical section 528 and ten extensions 530. Support assembly 502 also includes a lower backup member 532 that cooperates with lower cover 526 to receive and rotatably support pin ends 524 of lower link arms 520.

As best seen in FIGS. 7D-7G, anti extrusion assembly 504 includes a base member 534 and ten petals 536 rotatably mounted to base member 534. Base member 534 includes ten pins 538 that eccentrically extend from the body of base member 534 and are positioned relative to one another at 36 degree intervals. Each of the pins 538 has on opening 540 therethrough. Petals 536 each have a slot end 542 that includes an opening 544. Pins 538 of base member 534 are received within slot ends 542 of petals 536 such that a rod may be inserted through openings 540, 544, thereby enabling rotatable movement of petals 536 relative to base member 534. The eccentric arrangement of pins 538 and the curvature of petals 536 enable petals 536 to nest together in the running position to minimize the outer diameter of anti extrusion assembly 504.

Figure 7A:
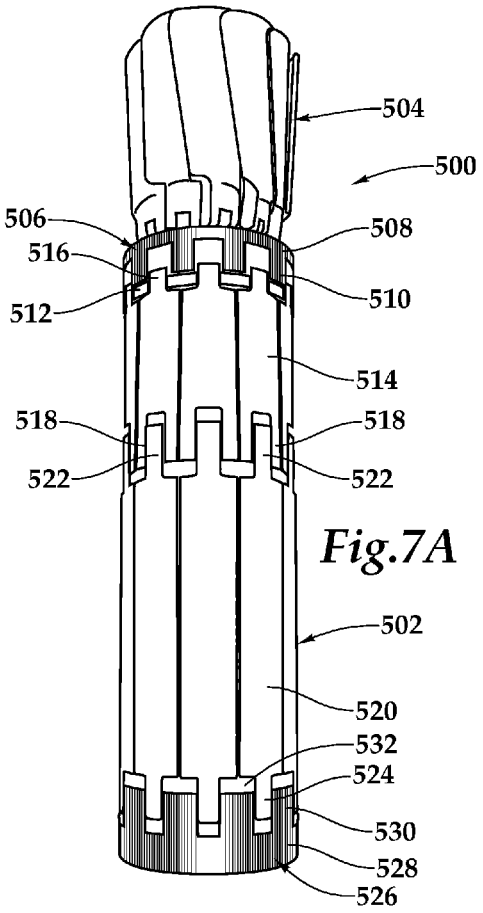
FIGS. 7A-7C are various views of a compression assembly for use in a through tubing bridge plug according to one embodiment of the present invention.
Figure 7B:
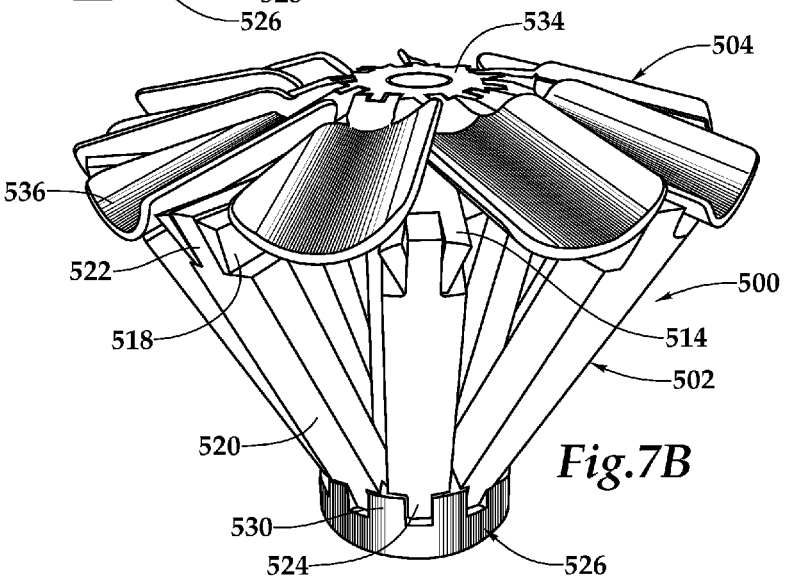
Figure 7C:
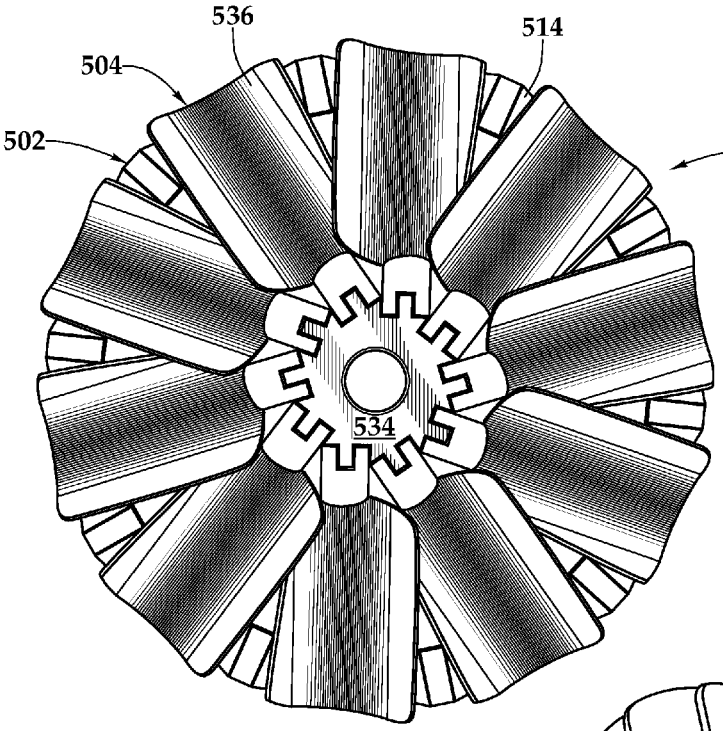
Figure 7E:
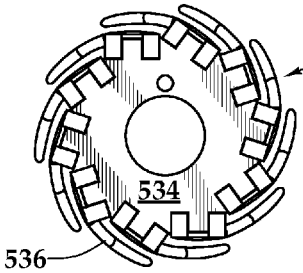
FIGS. 7D-7G are various views of an anti extrusion assembly and component parts thereof for use in a through tubing bridge plug according to one embodiment of the present invention.
Figure 7F:
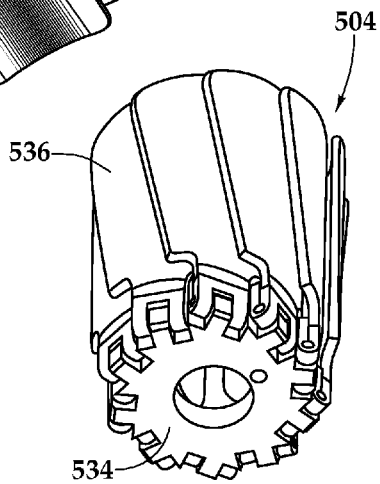
Figure 7D:
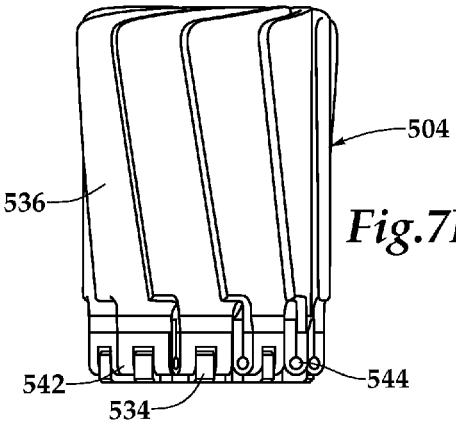
Figure 7G:
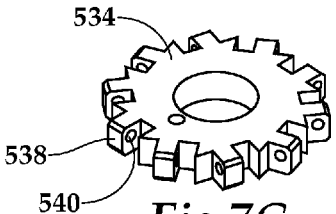

In operation, when downhole power unit 100 is operated to actuate through tubing bridge plug 200 as described above, compression assembly 500 is operated from its small diameter running configuration, wherein the outer surfaces of adjacent upper and lower link arms 514, 520 lie substantially in the same plane such that upper and lower link arms 514, 520 are substantially longitudinally oriented and petals 536 are nested (see FIG. 7A) to its large diameter operating configuration, wherein upper link arms 514 are substantially perpendicular to the casing wall and petals 536 substantially fill the gaps between upper link arms 514 (see FIGS. 7B-7C). More specifically, a compressive force is generated between upper cover 506 and lower cover 526. This compressive force is transferred to upper and lower link arms 514, 520, each pair of which rotate relative to one another such that the pin ends 522 of lower link arms 520 and the slot ends 518 of upper link arms 514 extend radially outwardly. Due to the difference in lengths of upper and lower link arms 514, 520, when support assembly 502 is fully deployed, the upper surfaces of upper link arms 514 are substantially perpendicular to the casing. In this configuration, upper link arms 514 provide a support platform for petals 536 when petals 536 rotate relative to base member 534 into contact with upper link arms 514. Preferably, as depicted in the illustrated embodiment, each of the petals 536 is supported by two upper link arms 514 and adjacent petals 536 overlap with one another near their slot ends 542. In this configuration, petals 536 lie in substantially the same plane and each petal 536 substantially fills the gap between the two supporting upper link arms 514 such that petals 536 and upper link arms 514 substantially fill the entire cross section of the wellbore to enable compression and prevent extrusion of packing assembly 224 during installation and operation.

Even though a particular embodiments of a compression assembly, a support assembly and an anti extrusion assembly have been depicted and described, it should be clearly understood by those skilled in the art that other types of compression assemblies, support assemblies and anti extrusion assemblies could alternatively be used in conjunction with the downhole power unit and through tubing bridge plug described herein without departing from the principles of the present invention. For example, it may be desirable to have the petals form a conical configuration rather than a substantially planar configuration in their fully deployed state. In this embodiment, the upper surfaces of the upper link arms may also have a conical configuration in order to provide support to the petals. Alternatively, the petals could be supported by the casing wall instead of the upper link arms. As another example, each of the petals could alternatively be supported by one of the upper link arms instead of by two upper link arms. Also, instead of rotating the petals from the running to the deployed configuration, the pin ends of the petals could alternatively be deformable to allow the petals to operate from the running to the deployed configuration. In addition, even though a single layer of petals is depicted, the anti extrusion assembly of the present invention could alternatively have two or more layers of petals, wherein the petals of each layer lie in substantially the same plane or wherein each of the layers forms a conical configuration.

Figure 8A:
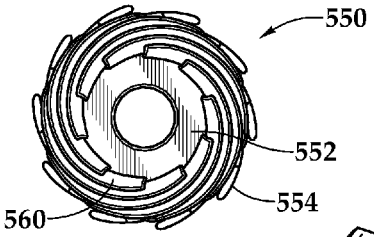
FIGS. 8A-8C are various views of another embodiment of an anti extrusion assembly for use in a through tubing bridge plug according to the present invention.
Figure 8B:
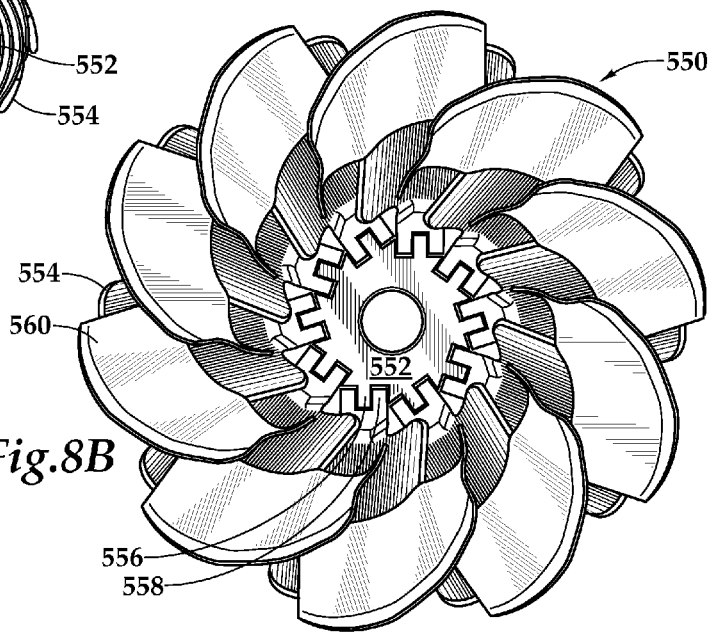
Figure 8C:
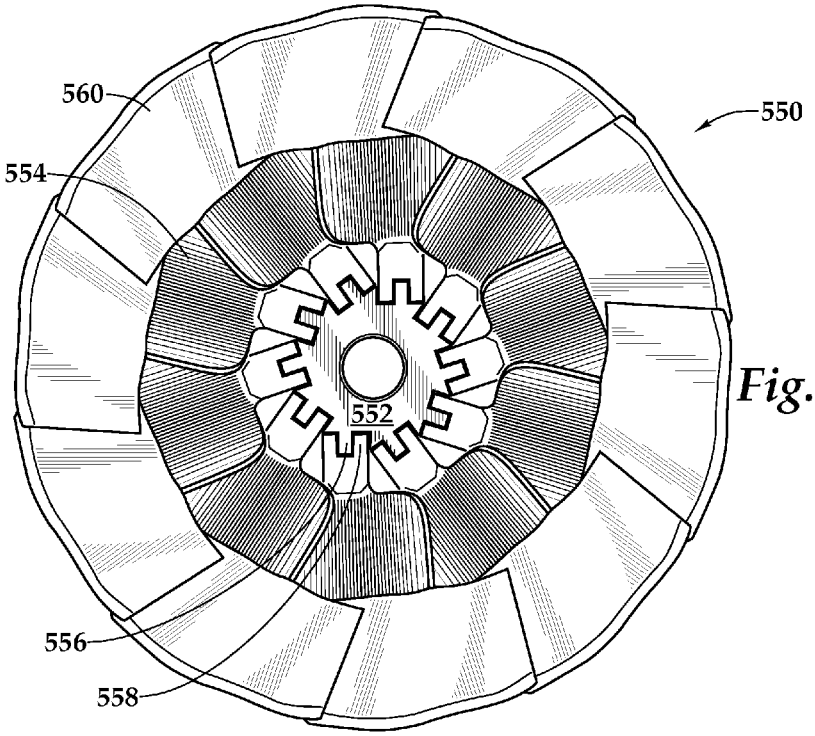

Referring next to FIGS. 8A-8C, therein are depicted various views of another embodiment of a anti extrusion assembly for use in a through tubing bridge plug of the present invention and that is generally designated 550. Anti extrusion assembly 550 includes a base member 552 and ten petals 554 that are rotatably mounted to base member 552. Base member 552 includes ten pins 556 that eccentrically extend from the body of base member 552 and are positioned relative to one another at 36 degree intervals. Each of the pins 556 has an opening therethrough. Petals 554 each have a slot end 558 that includes an opening. Pins 556 of base member 552 are received within slot ends 558 of petals 554 such that a rod may be inserted through the openings of pins 556 and slot ends 558, thereby enabling rotatable movement of petals 554 relative to base member 552 as described above. In addition, each of the petals 554 includes a webbing element 560. Preferably, webbing elements 560 are formed from a flexible material such as a sheet metal, a composite fabric such as kevlar, a polymer or the like. Webbing elements 560 may be attached to petals 554 using any suitable means such as welding, riveting, bolting, gluing or the like.

The eccentric arrangement of pins 538, the curvature of petals 536 and the flexibility of webbing elements 560 enables petals 536 and webbing elements 560 to nest together in the running position to minimize the outer diameter of anti extrusion assembly 550, as best seen in FIG. 8A. In the deployed position, as best seen in FIG. 8C, each of the petals 554 is preferably supported by two upper link arms of a support assembly, as described above. In this configuration, petals 554 and webbing elements 560 cooperate to substantially fill the entire cross section of the wellbore to enable compression and prevent extrusion of packing assembly 224 of a through tubing bridge plug during installation and operation. In certain embodiments, webbing elements 560 may interfere with the casing wall to further assure extrusion control. Even though the webbing elements are depicted being attached to the upper side of the petals, it should be understood by those skilled in the art that the webbing elements could alternatively be positioned on the underside of the petals. Also, even though the webbing elements are depicted overlapping one another, it should be understood by those skilled in the art that the webbing elements could alternatively be overlapped by a portion of the adjacent petal.

Figure 9:
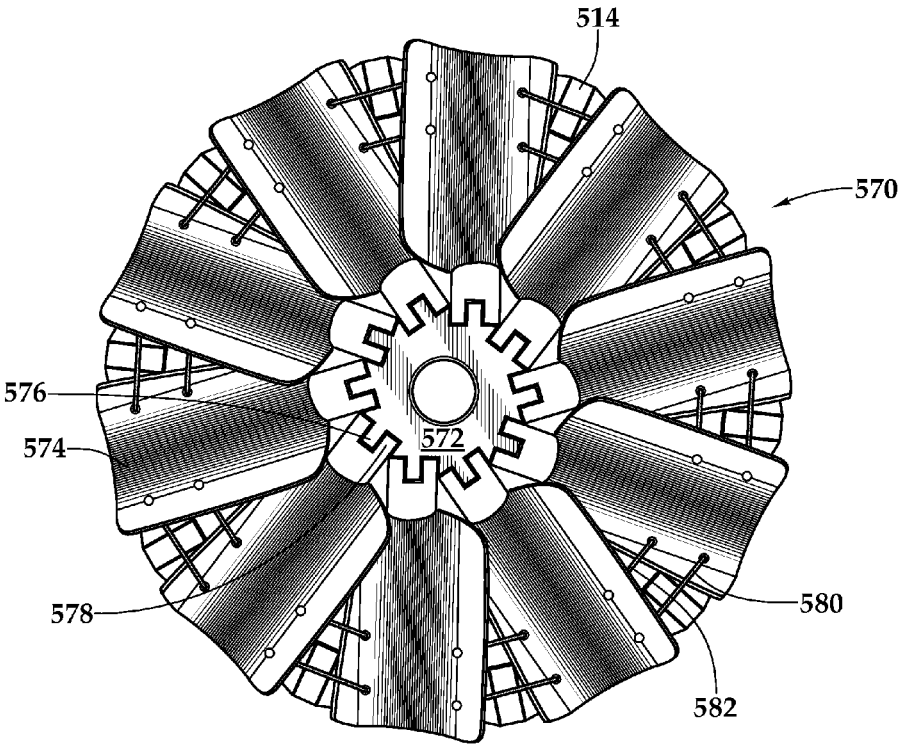
FIG. 9 is a top view of a further embodiment of an anti extrusion assembly for use in a through tubing bridge plug according to the present invention.

Referring next to FIG. 9, therein is depicted another embodiment of an anti extrusion assembly for use in a through tubing bridge plug of the present invention that is generally designated 570. Anti extrusion assembly 570 includes a base member 572 and ten petals 574 that are rotatably mounted to base member 572. Base member 572 includes ten pins 576 that eccentrically extend from the body of base member 572 and are positioned relative to one another at 36 degree intervals. Each of the pins 576 has an opening therethrough. Petals 574 each have a slot end 578 that includes an opening. Pins 576 of base member 572 are received within slot ends 578 of petals 574 such that a rod or other member may be inserted through the openings of pins 576 and slot ends 578, thereby enabling rotatable movement of petals 574 relative to base member 572 as described above.

In the illustrated embodiment, each petal 574 is independently coupled to its adjacent petals 574 by connecting members depicted as two radially spaced apart metal wires 580, 582. Alternatively, one or more wires could weave through all of the petals 574 to circumferentially extend around the entire anti extrusion assembly 570. As such, one or more circumferentially extending wires, one or more sets of connecting members or other similar system may be considered to be a stabilizer assembly. Even though a particular number of radially spaced apart connecting members has been described in the present embodiment, it is to be understood by those skilled in the art that other numbers of radially spaced apart connecting members both greater than and less than that specified are possible and are considered to be within the scope of the present invention. As depicted in the deployed position, each of the petals 574 is supported by two upper link arms 514 of a support assembly, as described above, and each petal 574 substantially fills the gap between the two supporting upper link arms 514. As such, petals 574 and upper link arms 514 cooperate together to substantially fill the entire cross section of the wellbore to enable compression and prevent extrusion of packing assembly 224. In addition, metal wires 580, 582 add to the hoop strength and stability of the petal system preventing any undesired movement of individual petals 574 caused by, for example, stress concentrations during compression of packing assembly 224.

Figure 10A:
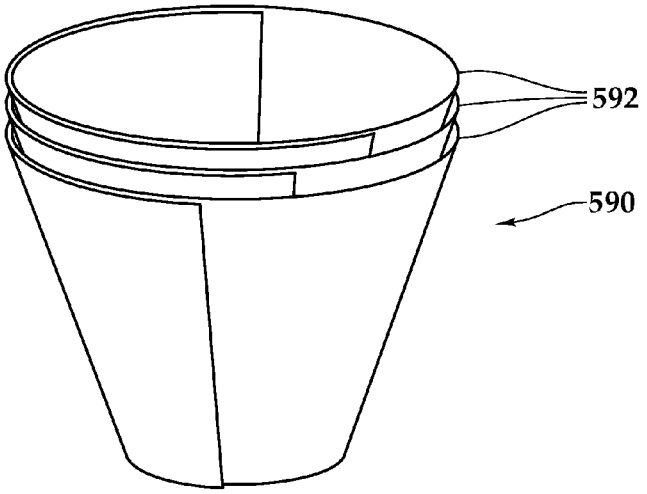
FIGS. 10A-10C are various views of yet another embodiment of an anti extrusion assembly for use in a through tubing bridge plug according to the present invention.
Figure 10B:
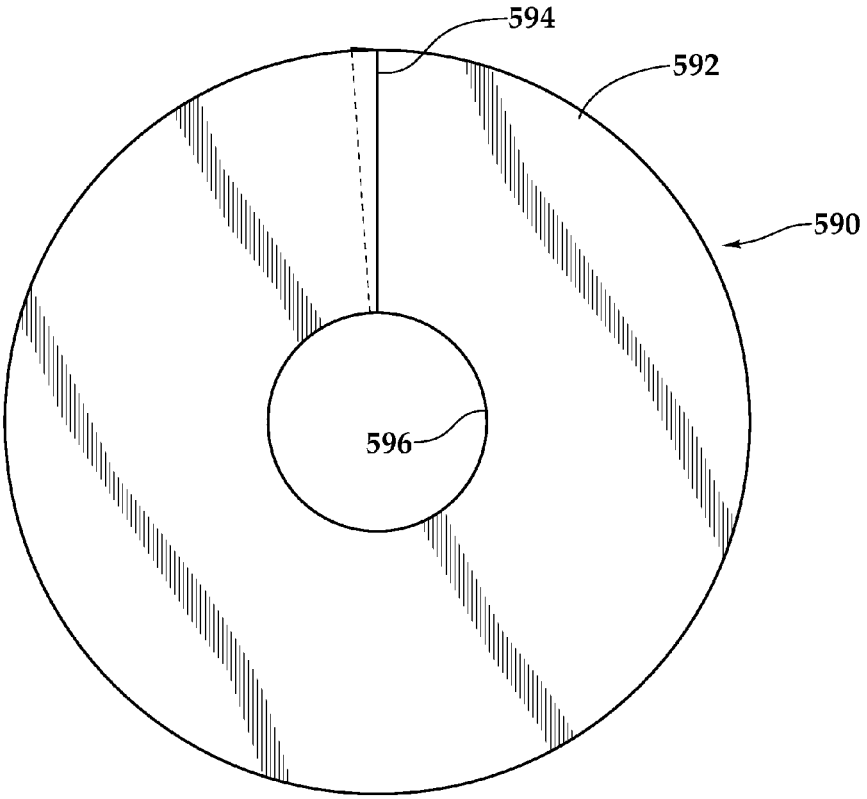
Figure 10C:
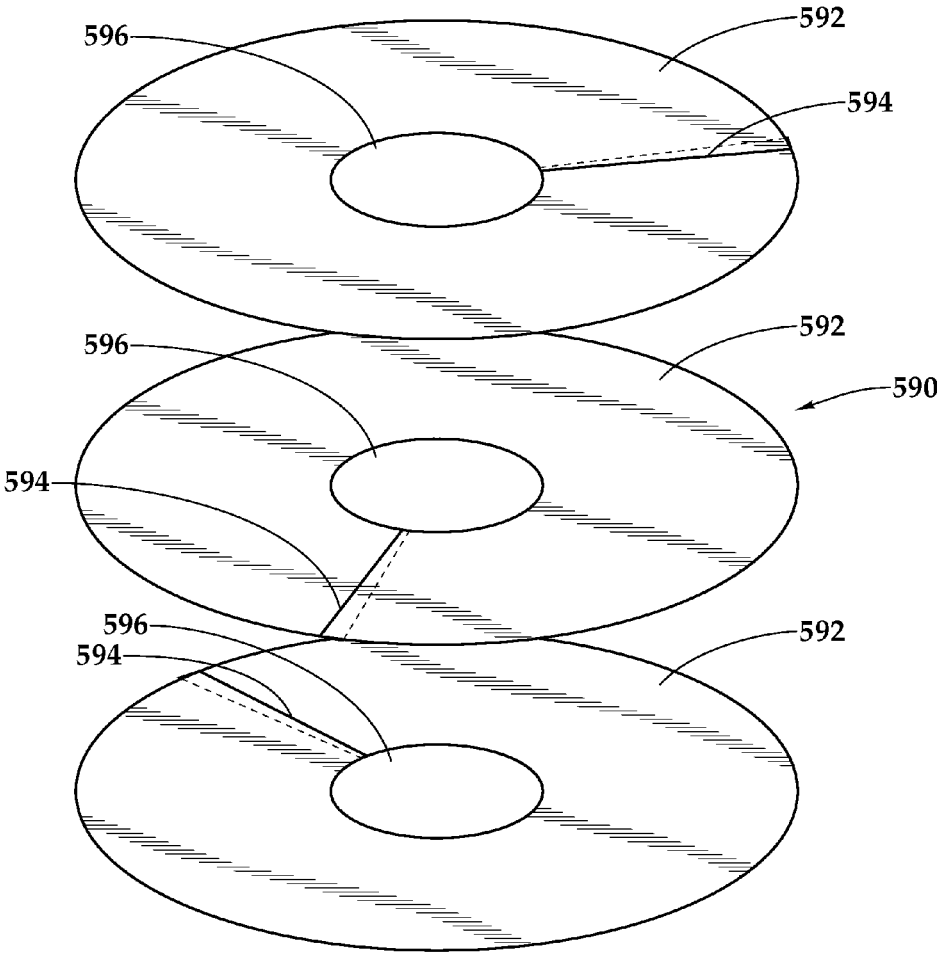

Referring next to FIGS. 10A-10C, therein is depicted another embodiment of an anti extrusion assembly for use in a through tubing bridge plug of the present invention that is generally designated 590. Anti extrusion assembly 590 includes three anti extrusion elements 592. Anti extrusion elements 592 may be used in place of or in addition to the petal type anti extrusion elements discussed above. Even though a particular number of anti extrusion elements has been described in the present embodiment, it is to be understood by those skilled in the art that other numbers of anti extrusion elements both greater than and less than that specified are possible and are considered to be within the scope of the present invention.

In the illustrated embodiment, each of the anti extrusion elements 592 is formed from a flexible material such as sheet metal, composite fabric have metal wire embedded therein for resilience or the like. Anti extrusion elements 592 have a slot 594 and a central opening 596. In the relaxed state, anti extrusion elements 592 take the form of a relatively flat ring shaped element, as best seen in FIGS. 10B and 10C. Slot 594 and central opening 596, however, enable anti extrusion elements 592 to be configured into a conical shape, as best seen in FIG. 10A. In this configuration, anti extrusion assembly 590 may be run in the well as part of the through tubing bridge plug described above. In the deployed position, anti extrusion elements 592 are supported by the upper link arms of a support assembly or the petals of an above described anti extrusion assembly. As such, anti extrusion assembly 590 substantially fills the entire cross section of the wellbore to enable compression and prevent extrusion of packing assembly 224 during installation and operation. As best seen in FIG. 10C, slots 594 of adjacent anti extrusion elements 592 are preferably misaligned in order to maximize the strength of anti extrusion assembly 590.

Figure 11A:
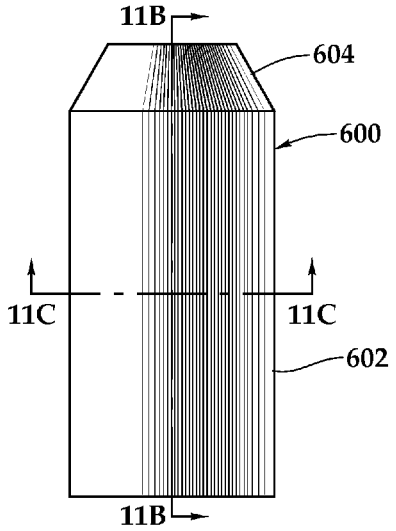
FIGS. 11A-11P are views of various embodiments of packing elements for use in a through tubing bridge plug according to the present invention.
Figure 11B:
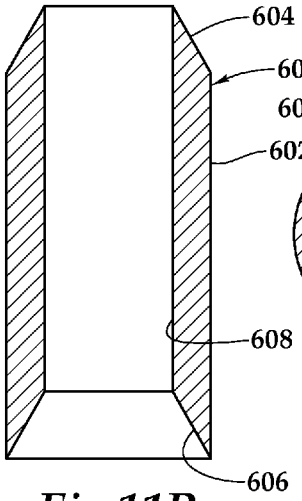
Figure 11C:
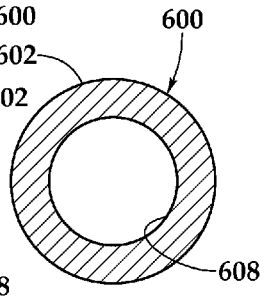
Figure 11D:
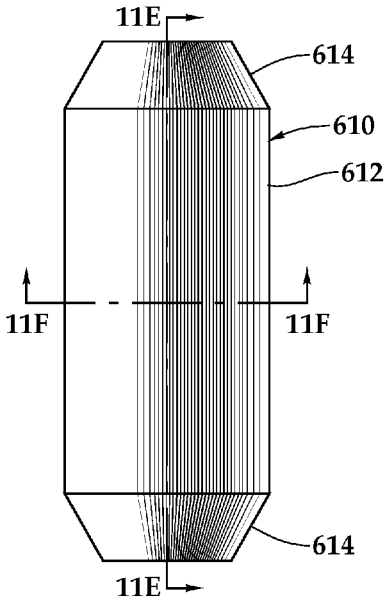
Figure 11E:
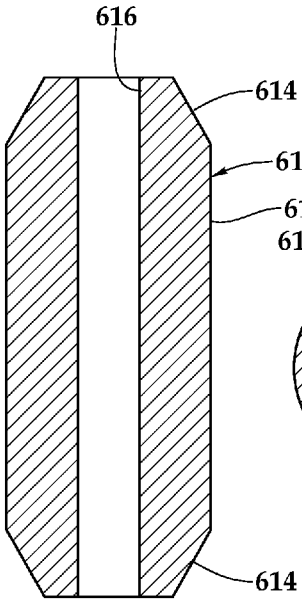
Figure 11F:
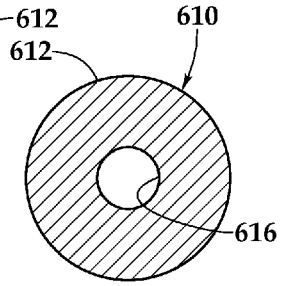
Figure 11G:
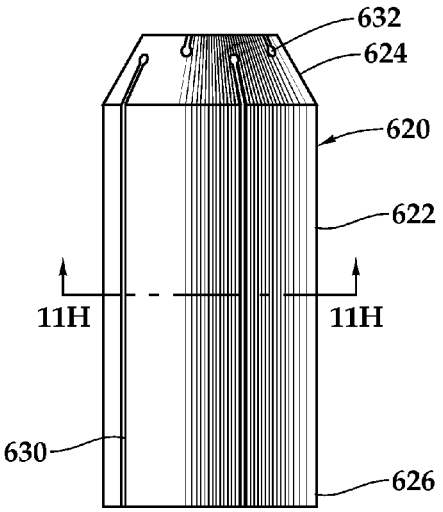
Figure 11H:
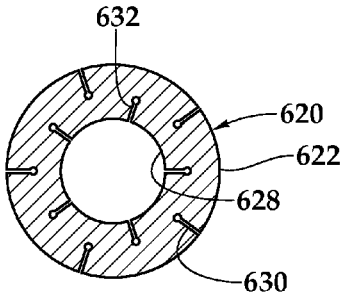
Figure 11I:
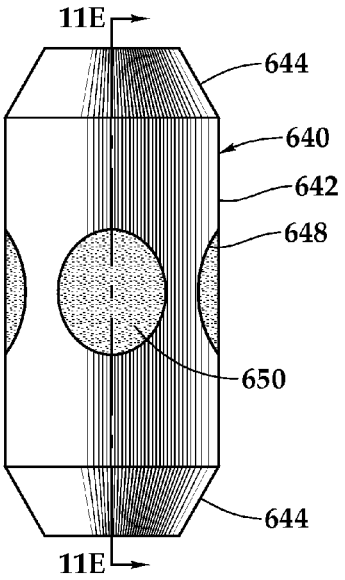
Figure 11J:
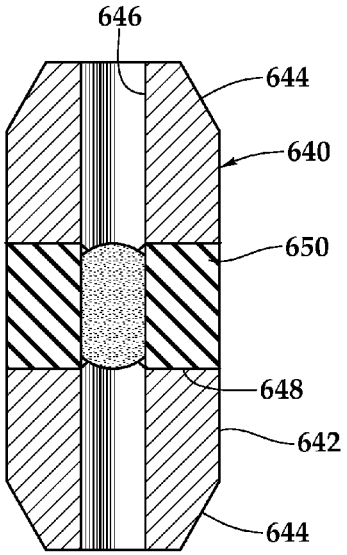
Figure 11K:
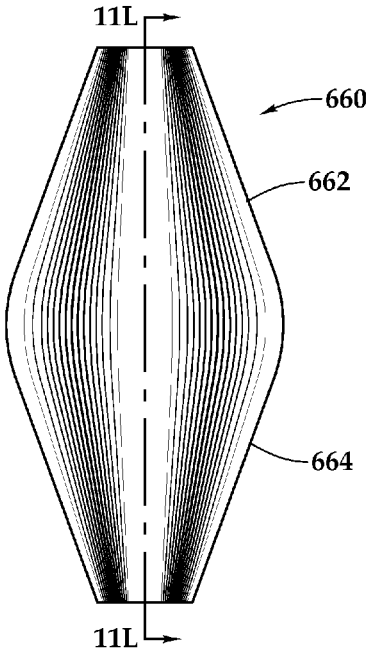
Figure 11L:
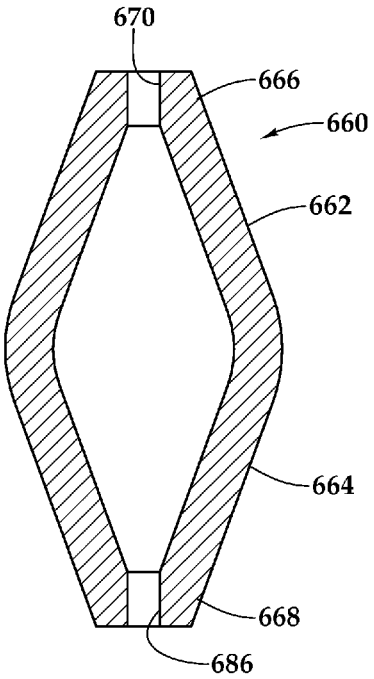
Figure 11M:
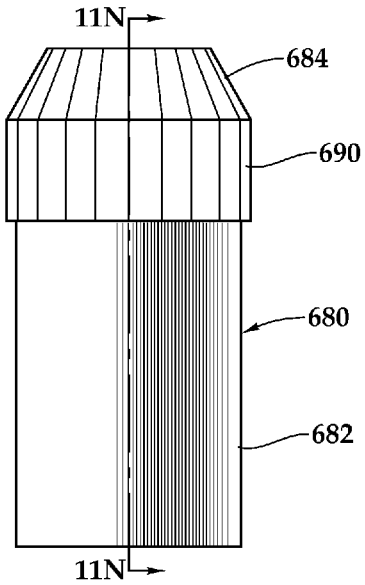
Figure 11N:
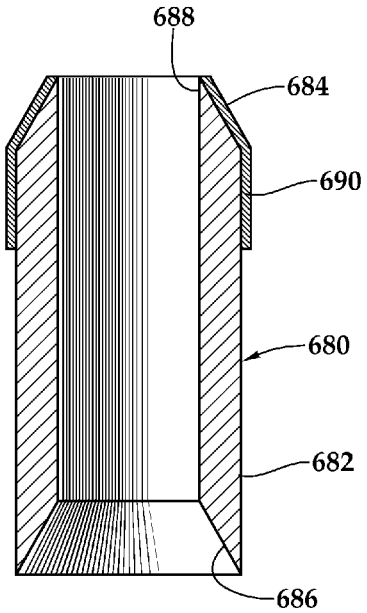
Figure 11O:
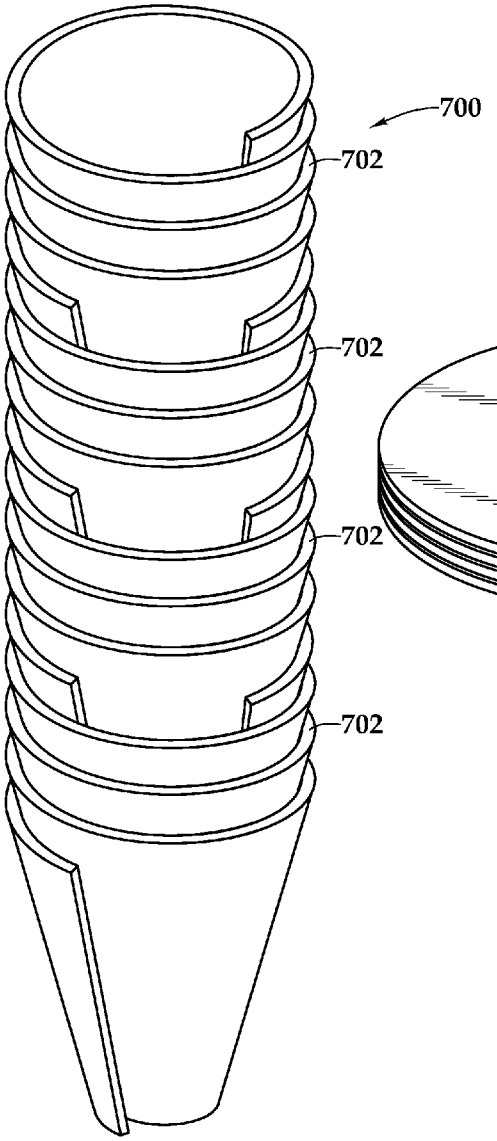
Figure 11P:
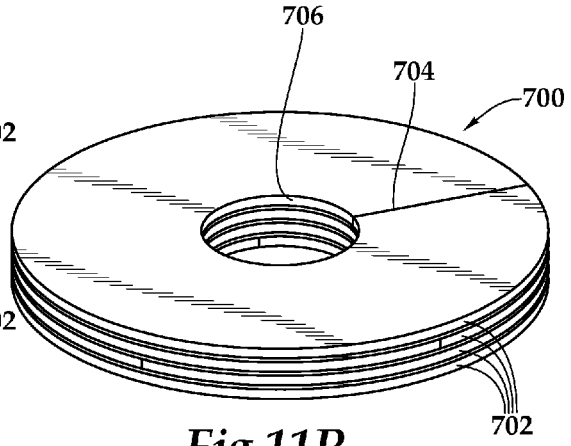

Referring next to FIGS. 11A-11P, therein are depicted various embodiments of packing elements for use in a through tubing bridge plug according to the present invention. As discussed above, use of downhole power unit 100 to install through tubing bridge plug 200 enables packing assembly 224 to be compressed in a controlled manner, unlike the prior art hydraulic and explosive setting techniques. The use of this controlled compression process allows packing elements to deform and move in a predictable manner relative to one another such that stress concentrations and extrusion can be minimized. As discussed above, the installation of through tubing bridge plug 200 involves upward displacement of actuation rod 208 which is coupled to end cap 246 on it lower end. This movement initially causes anchor assembly 212 to radially outwardly expand into contact with the casing wall creating a gripping engagement therewith, then causes support assemblies 216, 242 and anti extrusion assemblies 220, 238 to radially outwardly expand to a location proximate to the surface of the casing wall. Once in this configuration, further upward movement of actuation rod 208 causes anti extrusion assemblies 220, 238 to longitudinally compress packing assembly 224, thereby compressing and radially expanding packing elements 226 into contact with the casing wall creating a sealing engagement therewith. As depicted in FIGS. 3A-3D, packing elements 226 may preferably have particular directional orientations and are preferably positioned around one or more centralizers 229 to aid in the compression process and promote predictability thereof.

As best seen in FIGS. 11A-11C, a directional packing element for use in a through tubing bridge plug according to the present invention is illustrated and generally designated 600. Packing elements 600 have a generally cylindrical shape with an outer diameter 602 sized to allow passage of packing elements 600 through tubing. Packing elements 600 have a convex end 604 that is designed to nest with a concave end 606 of an adjacent packing element 600 in packing assembly 224. In addition, packing elements 600 have an inner diameter 608 sized to have a spaced apart relationship with actuation rod 208 which also allows for the inclusion of optional centralizers therebetween. The combination of the inner diameter 608 sizing and the nesting convex and concave ends 604, 606 enable packing elements 600 to longitudinally side over one another during the controlled compression process.

Preferably, packing elements 600 are formed from a polymer material such as an elastomer, a thermoset, a thermoplastic or the like. For example, the polymer material may be polychloroprene rubber (CR), natural rubber (NR), polyether eurethane (EU), styrene butadiene rubber (SBR), ethylene propylene (EPR), ethylene propylene diene (EPDM), a nitrile rubber, a copolymer of acrylonitrile and butadiene (NBR), carboxylated acrylonitrile butadiene (XNBR), hydrogenated acrylonitrile butadiene (HNBR), commonly referred to as highly-saturated nitrile (HSN), carboxylated hydrogenated acrylonitrile butadiene (XHNBR), hydrogenated carboxylated acrylonitrile butadiene (HXNBR) or similar material. Alternatively, the polymer material may be a flurocarbon (FKM), such as tetrafluoroethylene and propylene (FEPM), perfluoroelastomer (FFKM) or similar material. As another alternative, the polymer material may be polyphenylene sulfide (PPS), polyetherketone-ketone (PEKK), polyetheretherketone (PEEK), polyetherketone (PEK), polytetrafluorethylene (PTFE), polysulphone (PSU) or similar material. In addition, packing elements 600 may have an anti-friction coating on their inner surface, their outer surface or both to further enhance the predictability or the compression process.

As depicted in FIGS. 3A-3D, packing element 600 may be installed with certain of the packing elements 600 pointing in an uphole direction and certain of the packing elements 600 pointing in an downhole direction. A central packing element 610 may be positioned between these sets of directional packing elements 600, as best seen in FIGS. 11D-11F. Packing elements 610 have a generally cylindrical shape with an outer diameter 612 sized to allow passage of packing elements 610 through tubing. Packing elements 610 have a pair of convex ends 614 that are designed to nest with a concave end 606 of an adjacent packing element 600 in packing assembly 224. In addition, packing elements 610 have an inner diameter 616 sized to have a closely received relationship with actuation rod 208. Packing elements 610 may be formed from a material that is stiffer than the material used to form packing elements 600. The combination of the inner diameter 616 sizing, the nesting of convex ends 614 with concave ends 606 and the stiffness of the material used for packing elements 610 enable packing elements 610 to maintain a generally central position during the controlled compression process.

In certain embodiments, packing elements 610 are formed from a material that swells in response to contact with an activating fluid. Various techniques may be used for contacting the swellable material with appropriate activating fluid for causing swelling of swellable material. For example, the activating fluid may already be present in the well when, in which case swellable material preferably includes a mechanism for delaying the swelling of swellable material such as an absorption delaying or preventing coating or membrane, swelling delayed material compositions or the like. Alternatively, the activating fluid may be circulated through the well to swellable material after installed of through tubing bridge plug 200 in the well.

The swellable material may be formed from one or more materials that swell when contacted by an activation fluid, such as an inorganic or organic fluid. For example, the material may be a polymer that swells multiple times its initial size upon activation by an activation fluid that stimulates the material to expand. In one embodiment, the swellable material is a material that swells upon contact with and/or absorption of a hydrocarbon, such as an oil or a gas. The hydrocarbon is absorbed into the swellable material such that the volume of the swellable material increases creating a radial expansion of the swellable material.

Some exemplary swellable materials include elastic polymers, such as EPDM rubber, styrene butadiene, natural rubber, ethylene propylene monomer rubber, ethylene propylene diene monomer rubber, ethylene vinyl acetate rubber, hydrogenized acrylonitrile butadiene rubber, acrylonitrile butadiene rubber, isoprene rubber, chloroprene rubber and polynorbornene. These and other swellable materials swell in contact with and by absorption of hydrocarbons so that the swellable materials expand. In one embodiment, the rubber of the swellable materials may also have other materials dissolved in or in mechanical mixture therewith, such as fibers of cellulose. Additional options may be rubber in mechanical mixture with polyvinyl chloride, methyl methacrylate, acrylonitrile, ethylacetate or other polymers that expand in contact with oil.

In another embodiment, the swellable material is a material that swells upon contact with water. In this case, the swellable material may be a water-swellable polymer such as a water-swellable elastomer or water-swellable rubber. More specifically, the swellable material may be a water-swellable hydrophobic polymer or water-swellable hydrophobic copolymer and preferably a water-swellable hydrophobic porous copolymer. Other polymers useful in accordance with the present invention can be prepared from a variety of hydrophilic monomers and hydrophobically modified hydrophilic monomers. Examples of particularly suitable hydrophilic monomers which can be utilized include, but are not limited to, acrylamide, 2-acrylamido-2-methyl propane sulfonic acid, N,N-dimethylacrylamide, vinyl pyrrolidone, dimethylaminoethyl methacrylate, acrylic acid, trimethylammoniumethyl methacrylate chloride, dimethylaminopropylmethacrylamide, methacrylamide and hydroxyethyl acrylate.

A variety of hydrophobically modified hydrophilic monomers can also be utilized to form the polymers useful in accordance with this invention. Particularly suitable hydrophobically modified hydrophilic monomers include, but are not limited to, alkyl acrylates, alkyl methacrylates, alkyl acrylamides and alkyl methacrylamides wherein the alkyl radicals have from about 4 to about 22 carbon atoms, alkyl dimethylammoniumethyl methacrylate bromide, alkyl dimethylammoniumethyl methacrylate chloride and alkyl dimethylammoniumethyl methacrylate iodide wherein the alkyl radicals have from about 4 to about 22 carbon atoms and alkyl dimethylammonium-propylmethacrylamide bromide, alkyl dimethylammonium propylmethacrylamide chloride and alkyl dimethylammonium-propylmethacrylamide iodide wherein the alkyl groups have from about 4 to about 22 carbon atoms.

Polymers which are useful in accordance with the present invention can be prepared by polymerizing any one or more of the described hydrophilic monomers with any one or more of the described hydrophobically modified hydrophilic monomers. The polymerization reaction can be performed in various ways that are known to those skilled in the art, such as those described in U.S. Pat. No. 6,476,169 which is hereby incorporated by reference for all purposes.

Suitable polymers may have estimated molecular weights in the range of from about 100,000 to about 10,000,000 and preferably in the range of from about 250,000 to about 3,000,000 and may have mole ratios of the hydrophilic monomer(s) to the hydrophobically modified hydrophilic monomer(s) in the range of from about 99.98:0.02 to about 90:10.

Other polymers useful in accordance with the present invention include hydrophobically modified polymers, hydrophobically modified water-soluble polymers and hydrophobically modified copolymers thereof. Particularly suitable hydrophobically modified polymers include, but are not limited to, hydrophobically modified polydimethylaminoethyl methacrylate, hydrophobically modified polyacrylamide and hydrophobically modified copolymers of dimethylaminoethyl methacrylate and vinyl pyrollidone.

As another example, the swellable material may be a salt polymer such as polyacrylamide or modified crosslinked poly (meth)acrylate that has the tendency to attract water from salt water through osmosis wherein water flows from an area of low salt concentration, the formation water, to an area of high salt concentration, the salt polymer, across a semi permeable membrane, the interface between the polymer and the production fluids, that allows water molecules to pass therethrough but prevents the passage of dissolved salts therethrough.

Even with the controlled compression process and directional orientation of packing elements discussed above, it may be desirable to further engineer the deformation characteristics of the packing elements in packing assembly 224. As best seen in FIGS. 11G-11H, packing elements 620 have a generally cylindrical shape with an outer diameter 622 sized to allow passage of packing elements 620 through tubing. Packing elements 620 have a convex end 624 that is designed to nest with a concave end 626 of an adjacent packing element 620 in packing assembly 224. In addition, packing elements 620 have an inner diameter 628 sized to have a spaced apart relationship with actuation rod 208 which also allows for the inclusion of optional centralizers therebetween. Each packing elements 620 also includes a plurality of expansion slots 630 distributed about its outer diameter 622 and a plurality of expansion slots 632 distributed about its inner diameter 628. Expansion slots 630, 632 allow packing elements 620 to more easily radially expand without placing undue stress on the material of packing elements 620. Even though a particular number and orientation of expansion slots 630, 632 have been described in the present embodiment, it is to be understood by those skilled in the art that other numbers and orientations of expansion slots 630, 632 are possible and are considered to be within the scope of the present invention. For example, in a packing assembly 224, it may be desirable to have certain of the packing elements designed with few expansion slots or deeper expansion slots than other of the packing elements. Likewise, it may be desirable to have certain packing element with expansion slots on only the outer diameter or only the inner diameter. Further, it may be desirable to have packing element 620 used in conjunction with packing elements 600 within a given packing assembly 224.

As discussed above, it may also be desirable to have certain of the packing elements formed from one material or having certain material properties with other of the packing elements formed from another material or having different material properties. In the following example, a central packing element 640 is described but, it is to be understood by those skilled in the art that any of the packing elements or groups of packing elements could utilize different materials. Packing elements 640 are preferably formed from a rigid material such as a metal or hard plastic. Packing elements 640 have a generally cylindrical shape with an outer diameter 642 sized to allow passage of packing elements 640 through tubing. Packing elements 640 have a pair of convex ends 644 that are designed to nest with a concave end of an adjacent packing element in packing assembly 224. In addition, packing elements 640 have an inner diameter 646 sized to have a closely received relationship with actuation rod 208. In addition, packing elements 640 includes a pair of perpendicular holes 648 that pass through the center of packing element 640. Preferably, swellable polymer elements 650, formed from a material described above, are positioned within holes 648. The combination of the rigid material and the swellable elements helps to insure predictable compression of the packing assembly 224 and a complete seal with the casing wall.

Referring next to FIGS. 11K-11L, therein is another embodiment of a packing element 660 that is engineered to have specific deformation characteristics. As depicted, packing element 660 is in its resting state undergoing no compression induced deformation. In this state, packing elements 660 have a double conical shape including a upper cone 662 and a lower cone 664. At its upper and lower end 666, 668, packing elements 660 have inner diameters 670 that closely received on actuation rod 208. As illustrated, the inner diameters progressively increase toward a middle section 672 of packing elements 660. During run in, middle section 672 is radially compressed inwardly such that its outer diameter is sized to allow passage of packing elements 660 through tubing. This may be achieved by longitudinally stretching packing elements 660 or applying a mechanical force to packing elements 660. During installation downhole, the compressive forces acting on packing assembly 224 cause each packing element 660 to compress longitudinally by bending about its middle section 672 to form a two layered discoidal element that seals against the casing.

As best seen in FIGS. 11M-11N, a directional packing element for use in a through tubing bridge plug according to the present invention is illustrated and generally designated 680. Packing elements 680 have a generally cylindrical shape with an outer diameter 682 sized to allow passage of packing elements 680 through tubing. Packing elements 680 have a convex end 684 that is designed to nest with a concave end 686 of an adjacent packing element 680 in packing assembly 224. Packing elements 680 have an inner diameter 688 sized to have a spaced apart relationship with actuation rod 208. In addition, packing elements 680 have an outer cap 690 that is preferably formed from a rigid material such as metal. During installation, out caps 690 are operable to separate into petals that provide for separation between adjacent packing elements 680 such that each packing element 680 contacts the casing to provide a seal therewith.

Referring next to FIGS. 11A-11B, therein is depicted a section of a packing assembly for use in a through tubing bridge plug of the present invention and that is generally designated 700. Packing assembly 700 includes four packing elements 702. Even though a particular number of packing elements has been described in the present embodiment, it is to be understood by those skilled in the art that other numbers of packing elements both greater than and less than that specified are possible and are considered to be within the scope of the present invention.

In the illustrated embodiment, each of the packing elements 702 is formed from a material capable of sealing with the casing such as those polymeric materials discussed above. Packing elements 702 have a slot 704 and a central opening 706. In the relaxed state, packing elements 702 take the form of a relatively flat ring shaped element, as best seen in FIG. 11B. Slot 704 and central opening 706, however, enable packing elements 702 to be configured into a conical shape, as best seen in FIG. 11A. In this configuration, packing elements 702 may be run in the well as part of the through tubing bridge plug described above. During installation, significantly less compressive force is required to create the desired seal as the preferred state of packing elements 702 substantially fills the entire cross section of the wellbore. If desired, anti extrusion elements 592 may be inserted between some or all of the packing elements 702.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A system for providing a gripping and sealing engagement with a casing string of a wellbore having an uphole direction, the system comprising:

a downhole power unit having a power unit housing and a rotatable shaft; and a through tubing bridge plug including a housing and a single actuation rod having an exterior surface and a failure section positioned between first and second longitudinal sections of the single actuation rod, the power unit housing operably associated with the bridge plug housing, the rotatable shaft operably associated with the actuation rod;

the bridge plug further including:

an anchor assembly slidably disposed about the exterior surface of the actuation rod;

a pair of compression assemblies slidably disposed about the exterior surface of the actuation rod, each compression assembly including a support assembly and an anti extrusion assembly; and a packing assembly slidably disposed about the exterior surface of the actuation rod between the compression assemblies;

wherein, the actuation rod extends through the anchor assembly, the pair of compression assemblies and the packing assembly and does not include a flow passageway;

wherein, rotation of the rotatable shaft causes longitudinal movement of the actuation rod in the uphole direction relative to the anchor assembly, the pair of compression assemblies and the packing assembly causing actuation of the anchor assembly to establish the gripping engagement with the casing string, radially deployment of the compression assemblies such that the anti extrusion assemblies compress the packing assembly and actuation of the packing assembly to establish the sealing engagement with the casing string; and wherein, after establishing the gripping and sealing engagement with the casing string, continued longitudinal movement of the first longitudinal section of the single actuation rod in the uphole direction causes the first longitudinal section of the single actuation rod to separate from the second longitudinal section of the single actuation rod.

2. The system as recited in claim 1 wherein the anchor assembly further comprises:

a first slip assembly having a first sleeve and a plurality of first arms rotatably associated with the first sleeve, the first arms each having teeth on an end distal from the first sleeve;

a second slip assembly having a second sleeve and a plurality of second arms rotatably associated with the second sleeve, the second arms each having teeth on an end distal from the second sleeve; and at least one hinge member coupling respective first arms with second arms such that the teeth on the distal ends of respective first and second arms are moveable relative to one another, wherein the anchor assembly has a running configuration in which the first and second arms are substantially longitudinally oriented and an operating configuration in which respective first and second arms form an acute angle relative to one another such that the teeth of the first and second arms define the radially outermost portion of the anchor assembly.

3. The system as recited in claim 2 wherein the hinge members are bendable and further comprise in-line metal angles having notches creating preferential bending locations on the hinge member to guide movement of the first and second arms.

4. The system as recited in claim 1 wherein the anchor assembly further comprises:

a plurality of slip arm assemblies each including first and second arms hingeably coupled together, the first and second arms each having teeth on one end;

a first sleeve rotatably associated with each of the first arms; and a second sleeve rotatably associated with each of the second arms, wherein the anchor assembly has a running configuration in which the slip arm assemblies are substantially longitudinally oriented and an operating configuration in which the first and second arms of each slip arm assembly form an acute angle relative to one another such that the teeth of the first and second arms define the radially outermost portion of the anchor assembly.

5. The system as recited in claim 1 wherein each of the support assemblies further comprises a plurality of link arm assemblies each including a short arm pivotably mounted to a long arm, each support assembly having a running configuration in which the link arm assemblies are substantially longitudinally oriented and an operating configuration in which the short arms are pivoted relative to the long arms such that the short arms form a support platform and wherein each of the anti extrusion assemblies further comprises a base member and a plurality of petals operably associated with the base member, each anti extrusion assembly having a running configuration in which the petals are substantially perpendicular to the base member and nested relative to one another while spaced from the short arms and an operating configuration in which the petals are radially outwardly disposed substantially filling gaps between the short arms.

6. The system as recited in claim 5 wherein each of the petals of the anti extrusion assemblies is supported by two short arms of one of the support platforms when the support assemblies and the anti extrusion assemblies are in operating configurations.

7. The system as recited in claim 5 wherein at least a portion of each petal overlaps an adjacent petal when the anti extrusion assemblies are in the operating configuration.

8. The system as recited in claim 1 wherein the packing assembly further comprises two sets of oppositely directionally oriented packing elements having a central packing element therebetween.

9. The system as recited in claim wherein the failure section positioned between the first and second longitudinal sections of the single actuation rod further comprises a radially reduced section of the single actuation rod.

10. A method for establishing a gripping and sealing engagement with a casing string of a wellbore having an uphole direction, the method comprising:

providing a downhole power unit having a power unit housing and a rotatable shaft;

providing a through tubing bridge plug including a housing and a single actuation rod having an exterior surface and a failure section positioned between first and second longitudinal sections of the single actuation rod;

operably associating the power unit housing with the bridge plug housing and operably associating the rotatable shaft with the actuation rod;

conveying the bridge plug through a tubing string in the wellbore to a target location in the casing string, the bridge plug having an anchor assembly, a pair of compression assemblies and a packing assembly each slidably disposed about an exterior surface of the actuation rod, the actuation rod extends through the anchor assembly, the pair of compression assemblies and the packing assembly and does not include a flow passageway;

rotating the rotatable shaft to move the rotatable shaft relative to the power unit housing in the uphole direction;

responsive to the uphole movement of the shaft, applying a tensile force to the actuation rod in the uphole direction;

responsive to the tensile force, longitudinally shifting the actuation rod of the bridge plug in the uphole direction relative to the anchor assembly, the pair of compression assemblies and the packing assembly;

radially expanding the anchor assembly of the bridge plug to establish the gripping engagement with the casing string responsive to the longitudinal shifting the actuation rod in the uphole direction;

radially deploying the pair of compression assemblies of the bridge plug such that an anti extrusion assembly of each compression assembly and a support assembly of each compression assembly are deployed responsive to the longitudinal shifting the actuation rod in the uphole direction;

radially expanding the packing assembly disposed between the compression assemblies by longitudinally compressing the packing assembly with the compression assemblies to establish the sealing engagement with the casing string responsive to the longitudinal shifting the actuation rod in the uphole direction; and after establishing the gripping and sealing engagement with the casing string, separating the first longitudinal section of the single actuation rod from the second longitudinal section of the single actuation rod responsive to continued movement of the first longitudinal section of the single actuation rod in the uphole direction.

11. The method as recited in claim 10 wherein radially expanding the anchor assembly further comprises:

applying a compressive force between first and second slip assemblies of the anchor assembly; and rotating a plurality of first arms with teeth relative to a first sleeve of the first slip assembly and rotating a plurality of second arms with teeth relative to a second sleeve of the second slip assembly, thereby shifting the anchor assembly from a running configuration in which the first and second arms are substantially longitudinally oriented to a gripping configuration in which the respective first and second arms form an acute angle relative to one another and the teeth of the first and second arms define the radially outermost portion of the anchor assembly to establish a gripping engagement with the casing string.

12. The method as recited in claim 10 wherein radially deploying the compression assemblies further comprises:

operating the support assembly of each compression assembly from a running configuration in which link arm assemblies are substantially longitudinally oriented to an operating configuration in which short arms are pivoted relative to long arms of the link arm assemblies to form a support platform; and operating the anti extrusion assembly of each compression assembly from a running configuration in which petals are substantially perpendicular to a base member and nested relative to one another to an operating configuration in which the petals are radially outwardly disposed substantially filling gaps between the short arms.

13. The method as recited in claim 10 wherein the failure section positioned between the first and second longitudinal sections of the single actuation rod further comprises a radially reduced section of the single actuation rod.

* * * * *

UNITED STATES PATENT AND TRADEMARK OFFICE

CERTIFICATE OF CORRECTION

PATENT NO. : 9,051,812 B2
APPLICATION NO. : 12/889367
DATED : June 9, 2015
INVENTOR(S) : Clemens et al.

It is certified that error appears in the above-identified patent and that said Letters Patent is hereby corrected as shown below:

Title Page, please insert item --[30] Foreign Priority PCT/US2009/058516 09-28-2009--

Signed and Sealed this
Twelfth Day of April, 2016

Michelle K. Lee

Michelle K. Lee
*Director of the United States Patent and Trademark Office*